US011585644B2

(12) United States Patent
Nguyen et al.

(10) Patent No.: US 11,585,644 B2
(45) Date of Patent: Feb. 21, 2023

(54) MASS REDUCING PROJECTILE AND METHOD THEREFOR

(71) Applicant: The Boeing Company, Chicago, IL (US)

(72) Inventors: Ngoc Hoang Nguyen, Garden Grove, CA (US); Catherine D. Cannova, Huntington Beach, CA (US); Steven J. Adam, Orange, CA (US); Daniel A. Watts, Surfside, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 17/573,316

(22) Filed: Jan. 11, 2022

(65) Prior Publication Data

US 2022/0299302 A1 Sep. 22, 2022

Related U.S. Application Data

(60) Provisional application No. 63/146,215, filed on Feb. 5, 2021.

(51) Int. Cl.

| | |
|---|---|
| ***F42B 10/48*** | (2006.01) |
| ***F42B 12/62*** | (2006.01) |
| ***F42B 39/00*** | (2006.01) |
| ***F42B 5/16*** | (2006.01) |
| ***F42B 33/14*** | (2006.01) |

(52) U.S. Cl.

CPC ..... *F42B 10/48* (2013.01); *F42B 5/16* (2013.01); *F42B 12/62* (2013.01); *F42B 33/14* (2013.01); *F42B 39/002* (2013.01)

(58) Field of Classification Search

CPC ..... F42B 10/48; F42B 12/56; F42B 12/62

See application file for complete search history.

(56) References Cited

U.S. PATENT DOCUMENTS

| | | | | | |
|---|---|---|---|---|---|
| 174,325 | A * | 2/1876 | Tyler | F42B 12/62 | 102/489 |
| 1,203,649 | A * | 11/1916 | Papuga | F42B 5/03 | 102/456 |
| 2,112,614 | A * | 3/1938 | Wiley | F42B 4/28 | 244/142 |
| 2,892,401 | A * | 6/1959 | Michelson | F42B 22/10 | 102/414 |
| 3,611,931 | A * | 10/1971 | Bessey | F42B 12/62 | 102/393 |
| 3,665,857 | A * | 5/1972 | Radnich | F42B 39/00 | 102/481 |
| 3,677,182 | A * | 7/1972 | Peterson | F42B 12/50 | 102/505 |
| 4,026,269 | A * | 5/1977 | Stelzer | F24S 50/80 | 126/694 |
| 5,311,820 | A * | 5/1994 | Ellingsen | F02K 9/343 | 60/39.1 |
| 6,357,699 | B1 * | 3/2002 | Edberg | B64G 1/645 | 102/377 |

(Continued)

*Primary Examiner* — Derrick R Morgan

(74) *Attorney, Agent, or Firm* — Perman & Green, LLP

(57) ABSTRACT

A mass reducing projectile is provided. The mass reducing projectile includes a shell, one or more weights, and a low melt fusible alloy. The one or more weights are disposed within the shell. The low melt fusible alloy is disposed within the shell so as to encase the one or more weights within the shell.

20 Claims, 15 Drawing Sheets

(56) References Cited

U.S. PATENT DOCUMENTS

| | | | | |
|---|---|---|---|---|
| 8,250,987 | B1 * | 8/2012 | Morley | F42B 12/06 102/438 |
| 8,640,622 | B2 * | 2/2014 | Eckstein | F42B 12/60 102/438 |
| 9,121,679 | B1 * | 9/2015 | Kim | F42B 8/12 |
| 9,157,713 | B1 * | 10/2015 | Peterson | F42B 10/48 |
| 9,329,008 | B1 * | 5/2016 | Gilbert | F42B 12/02 |
| 11,118,865 | B2 * | 9/2021 | Pigott | F42B 12/64 |
| 2009/0211484 | A1 * | 8/2009 | Truitt | F42B 12/50 102/497 |
| 2012/0180691 | A1 * | 7/2012 | Sar | F42B 12/34 102/517 |
| 2018/0135953 | A1 * | 5/2018 | Bruno | F42B 33/02 |
| 2020/0208951 | A1 * | 7/2020 | Allison | F42B 12/62 |

* cited by examiner

MASS REDUCING PROJECTILE AND METHOD THEREFOR

CROSS-REFERENCE TO RELATED APPLICATIONS

This application is a non-provisional of and claims the benefit of U.S. Provisional patent application No. 63/146,215 filed on Feb. 5, 2021, the disclosure of which is incorporated herein by reference in its entirety.

1. FIELD

The embodiments generally relate to munitions or kinetic energy projectiles and in particular to projectiles having a self-reducing mass.

2. BRIEF DESCRIPTION OF RELATED DEVELOPMENTS

Projectiles are generally fired at a predetermined target however, in some instances the projectile does not impact or otherwise misses that predetermined target. Depending on the velocity and trajectory of the projectile the projectile may continue to travel some distance after passing the predetermined target. In an attempt to mitigate a missed target self-guided or wire-guided projectiles have been employed. However, these self-guided or wire-guided projectiles are expensive.

SUMMARY

Accordingly, apparatuses and methods, intended to address at least the above-identified concerns, would find utility.

The following is a non-exhaustive list of examples, which may or may not be claimed, of the subject matter according to the present disclosure.

One example of the subject matter according to the present disclosure relates to a mass reducing projectile comprising: a shell; one or more weights disposed within the shell; and a low melt fusible alloy disposed within the shell so as to encase the one or more weights within the shell.

Another example of the subject matter according to the present disclosure relates to a method forming a mass reducing projectile that comprises a shell, one or more weights, and a low melt fusible alloy, the method comprising: stably holding the shell; inserting the one or more weights into an internal cavity of the shell; and inserting the low melt fusible alloy into the internal cavity so as to fill the internal cavity and encase the one or more weights within the internal cavity.

Still another example of the subject matter according to the present disclosure relates to a munition comprising: a casing; an igniter disposed at least partially within the casing; a propellant disposed within the casing and in communication with the igniter; and a mass reducing projectile disposed at least partially within the casing so as to seal the propellant within the casing, the mass reducing projectile comprising: a shell; one or more weights disposed within the shell; and a low melt fusible alloy disposed within the shell so as to encase the one or more weights within the shell.

BRIEF DESCRIPTION OF THE DRAWINGS

Having thus described examples of the present disclosure in general terms, reference will now be made to the accompanying drawings, which are not necessarily drawn to scale, and wherein like reference characters designate the same or similar parts throughout the several views, and wherein:

FIG. 1 is perspective illustration of a mass reducing projectile in accordance with aspects of the present disclosure;

FIG. 1A is a block diagram of a munition including a mass reducing projectile in accordance with aspects of the present disclosure;

FIG. 1B is a schematic illustration of a mass reducing projectile assembled in munition in accordance with aspects of the present disclosure;

FIG. 2 is a perspective illustration of constituent parts of the mass reducing projectile of FIG. 1 in accordance with aspects of the present disclosure;

FIG. 3 is a plan view illustration of constituent parts of the mass reducing projectile of FIG. 1 in accordance with aspects of the present disclosure;

FIG. 4A is a schematic illustration of the mass reducing projectile of FIG. 1 showing, with dashed lines, one or more weights and an internal cavity of the mass reducing projectile in accordance with aspects of the present disclosure;

FIG. 4B is a schematic base end view illustration of the mass reducing projectile of FIG. 1 showing, with dashed lines, one or more weights in accordance with aspects of the present disclosure;

FIG. 5 is an $|_{[P(MV1]}$example flow diagram of a method in accordance with aspects of the present disclosure;

FIG. 6 is a schematic illustration of an ejection of portions of the mass reducing projectile of FIG. 1 in accordance with aspects of the present disclosure;

FIG. 7 is a schematic exploded illustration of a mass reducing projectile in accordance with aspects of the present disclosure;

FIG. 8 is a schematic illustration of a mass reducing projectile assembled in a munition in accordance with aspects of the present disclosure;

Figure 8:
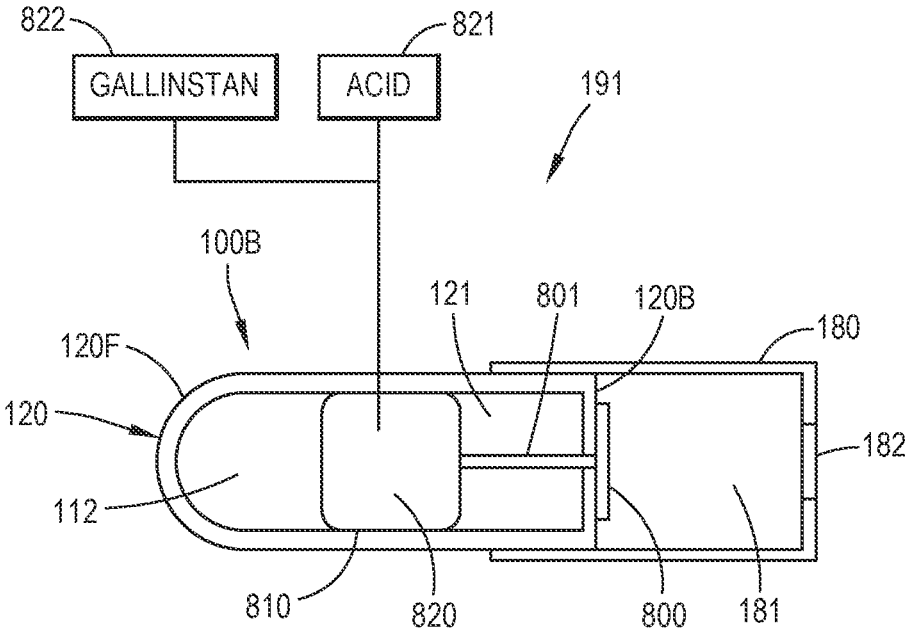
Figure 9:
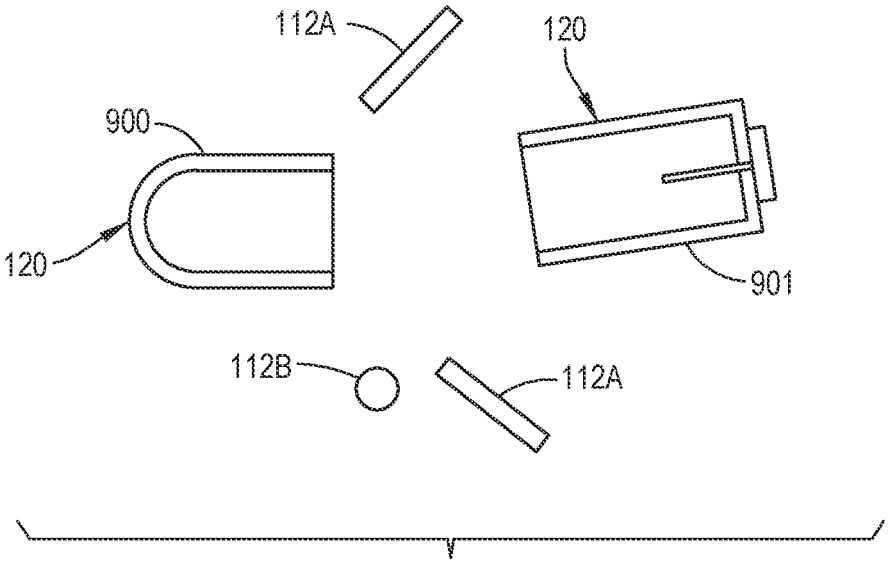
Figure 10A:
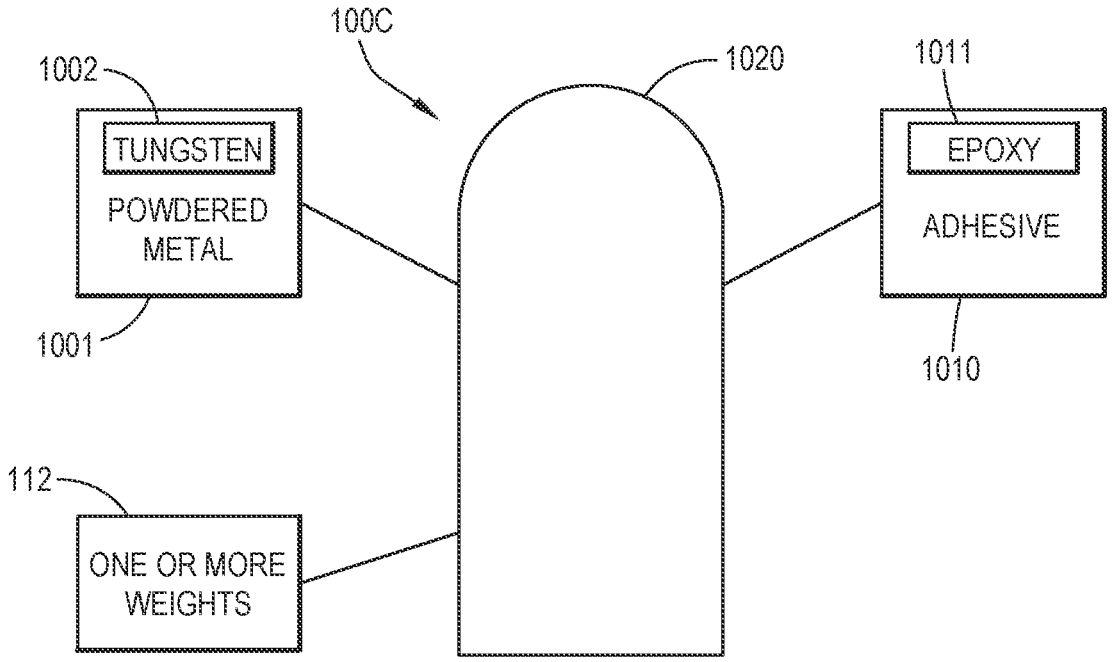
Figure 10B:
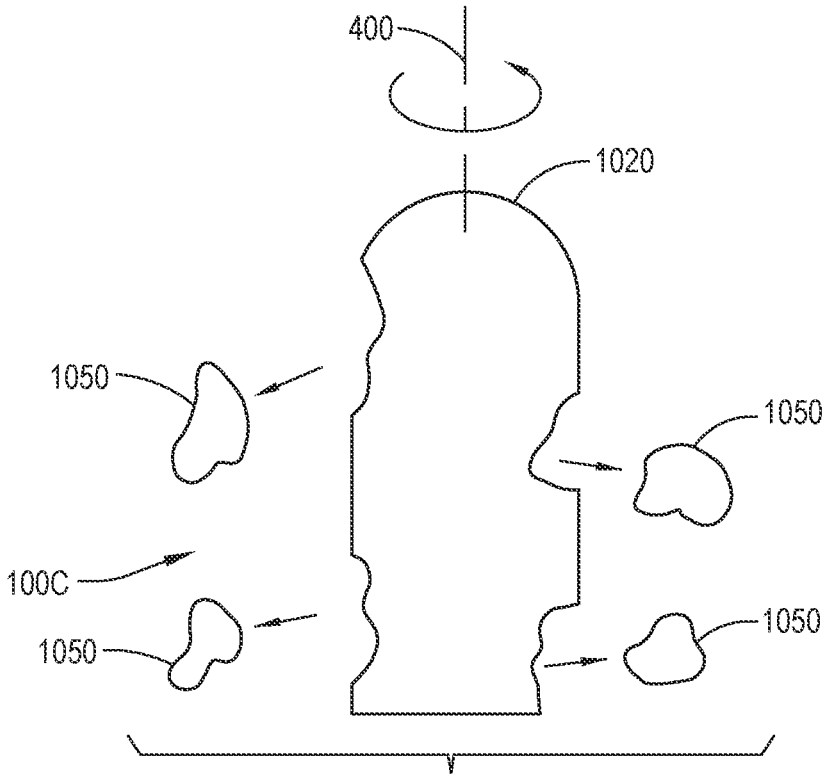
Figure 11A:
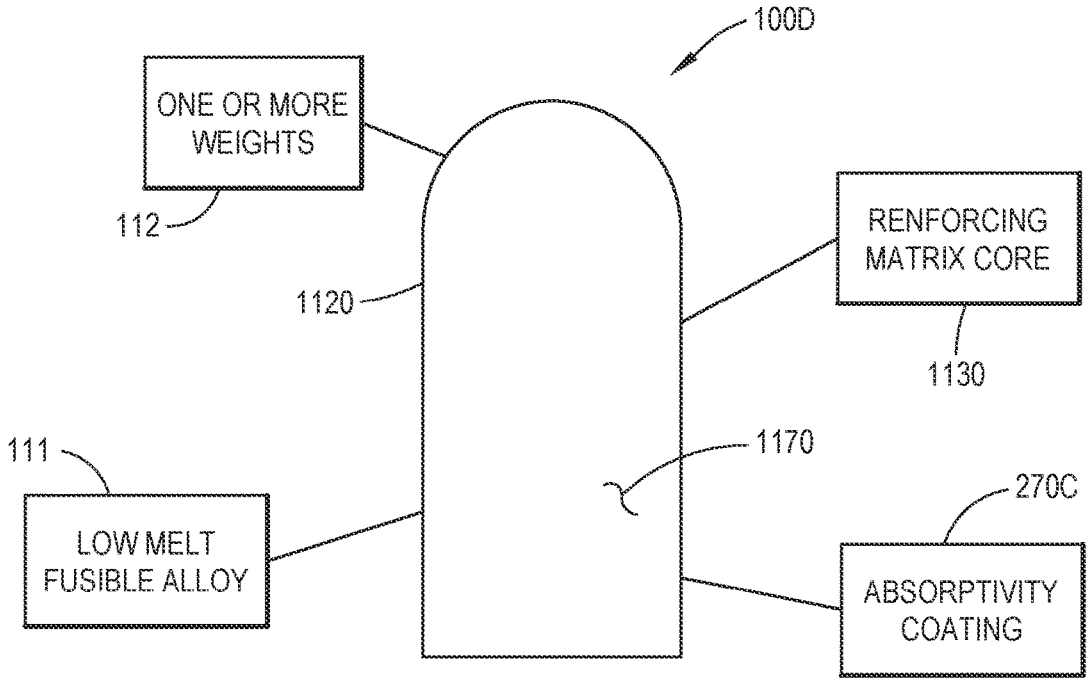
Figure 11B:
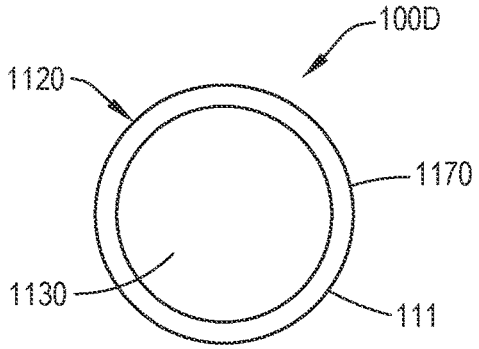
Figure 11C:
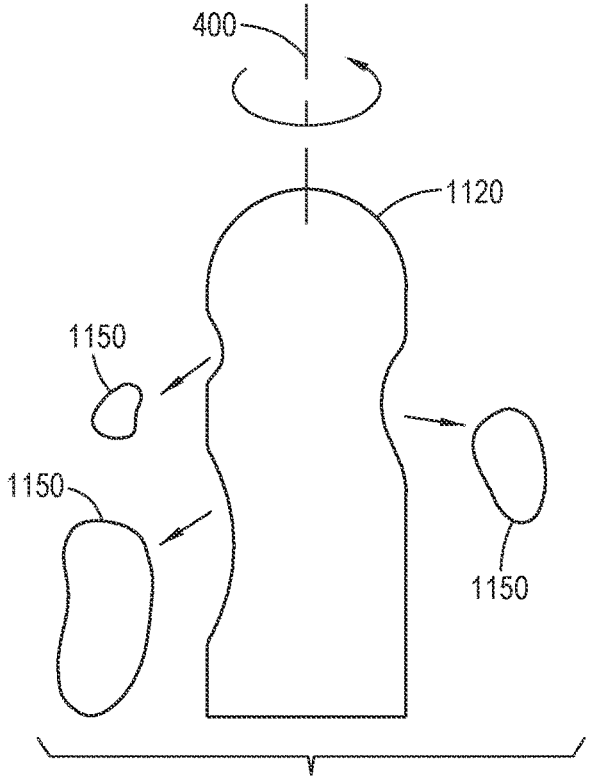
Figure 12B:
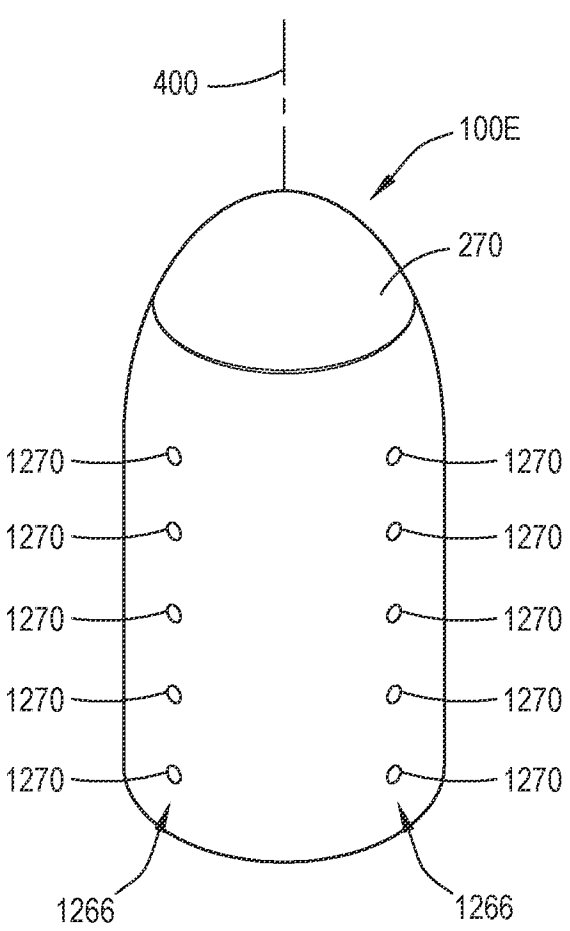
Figure 12A:
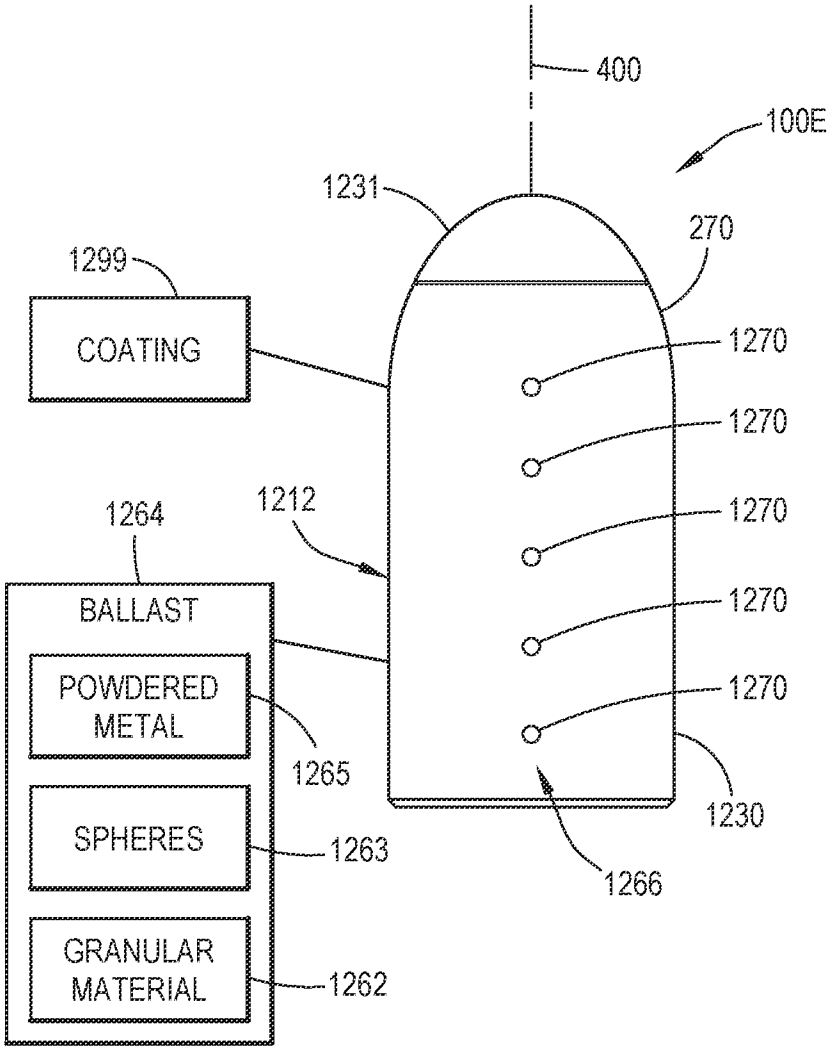
Figure 12D:
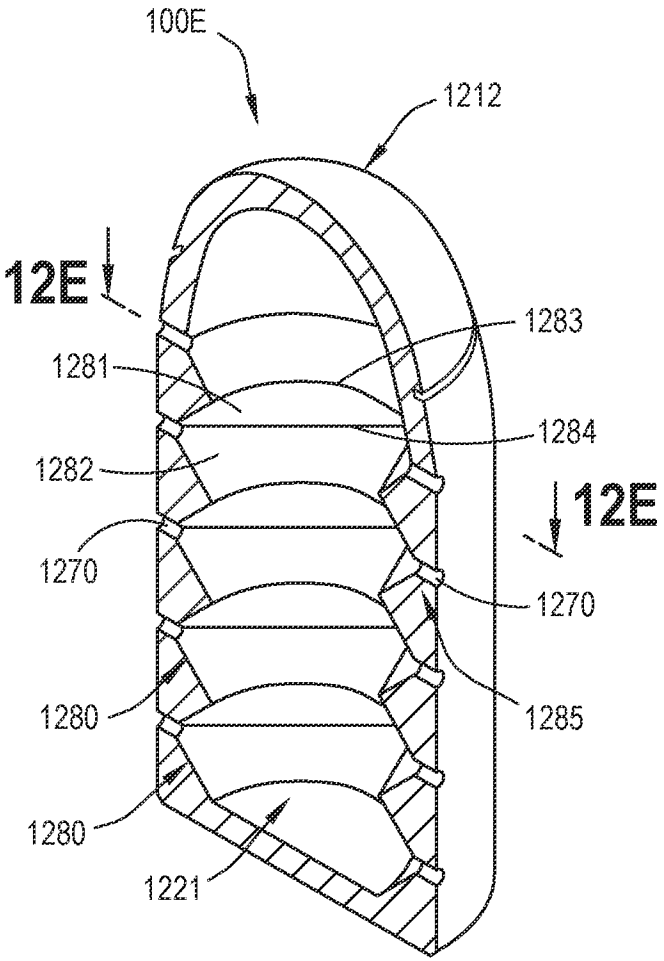
Figure 12C:
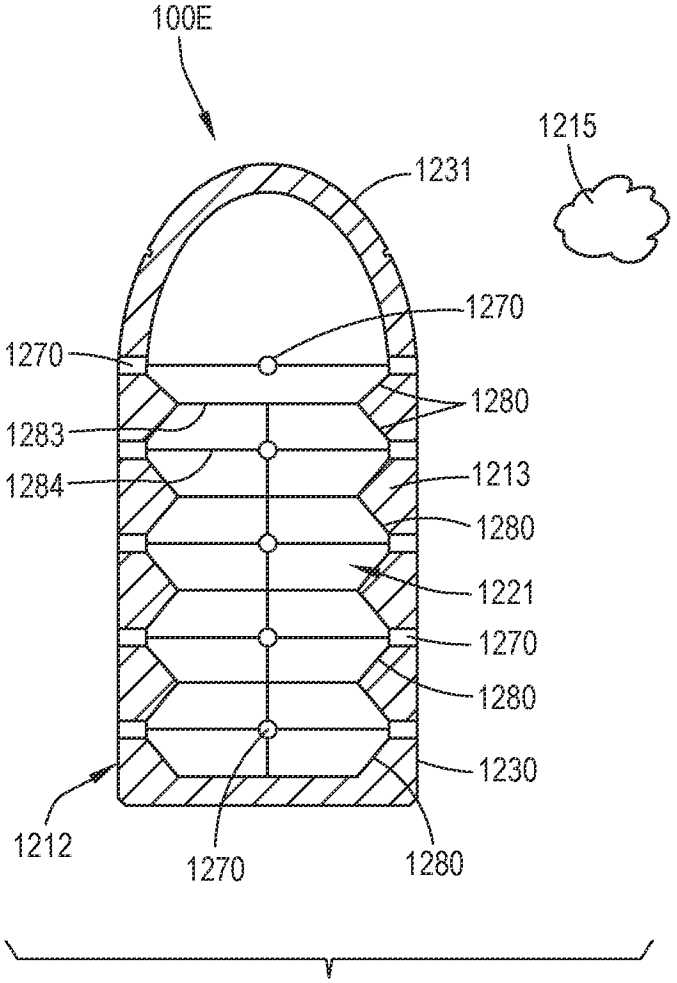
Figure 12F:
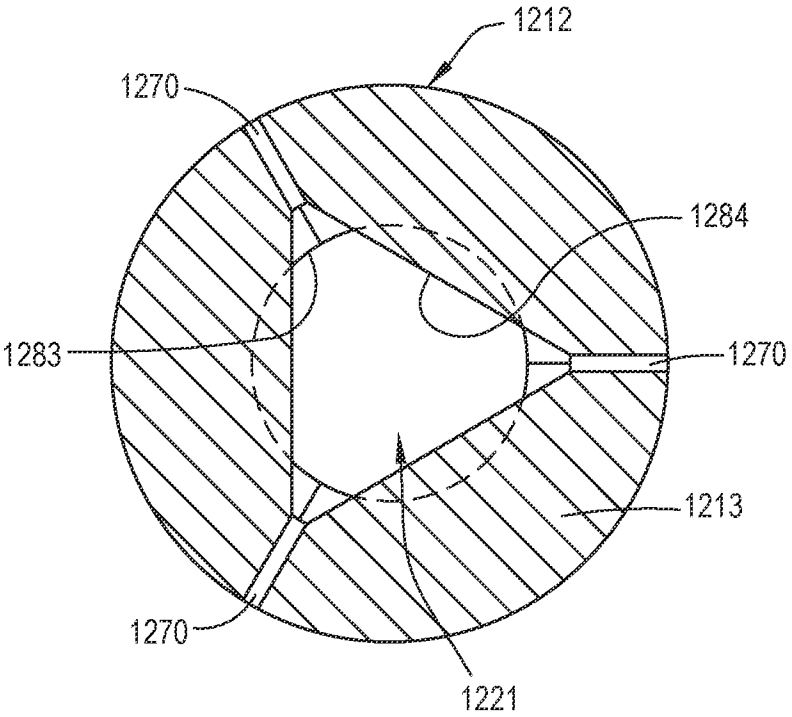
Figure 12E:
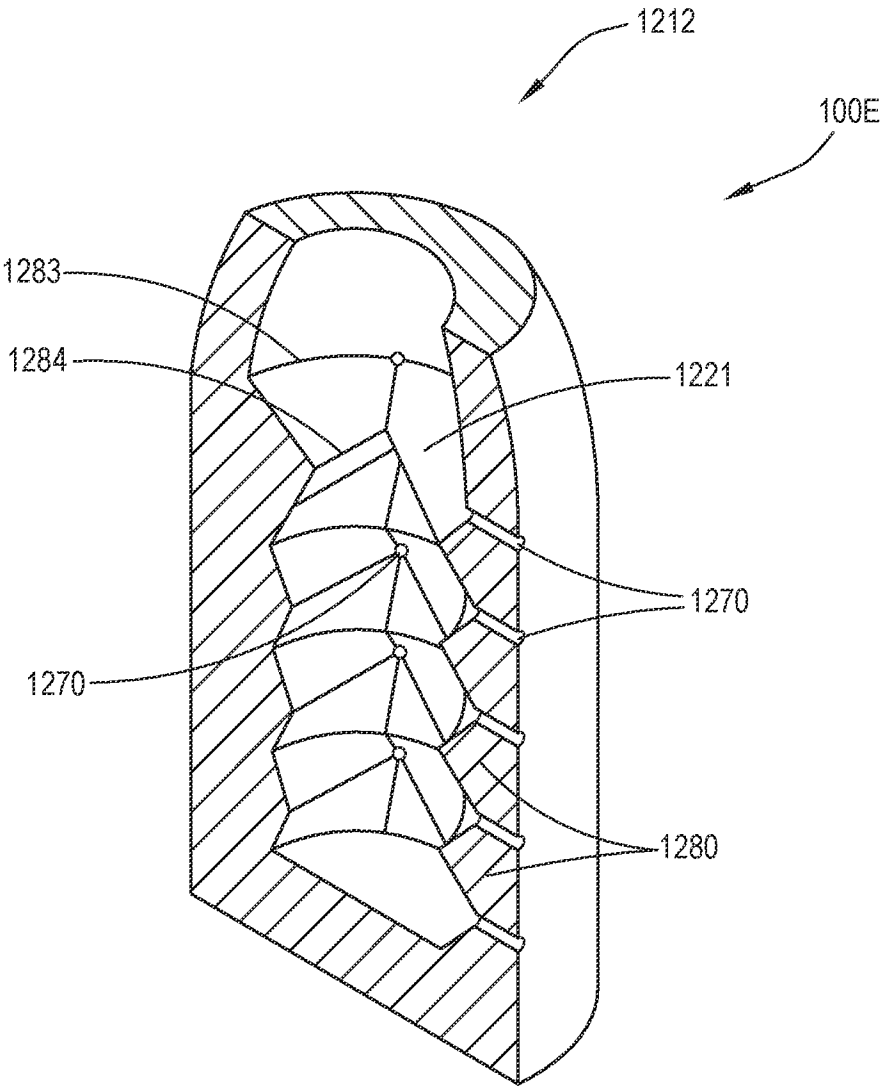
Figure 13B:
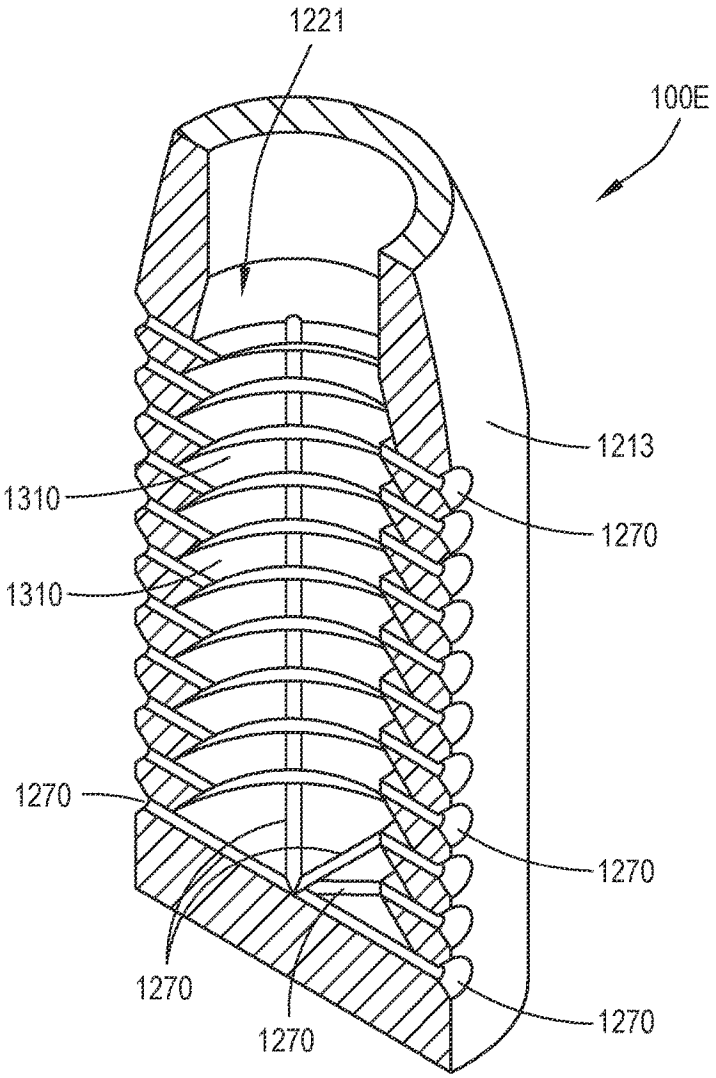
Figure 13A:
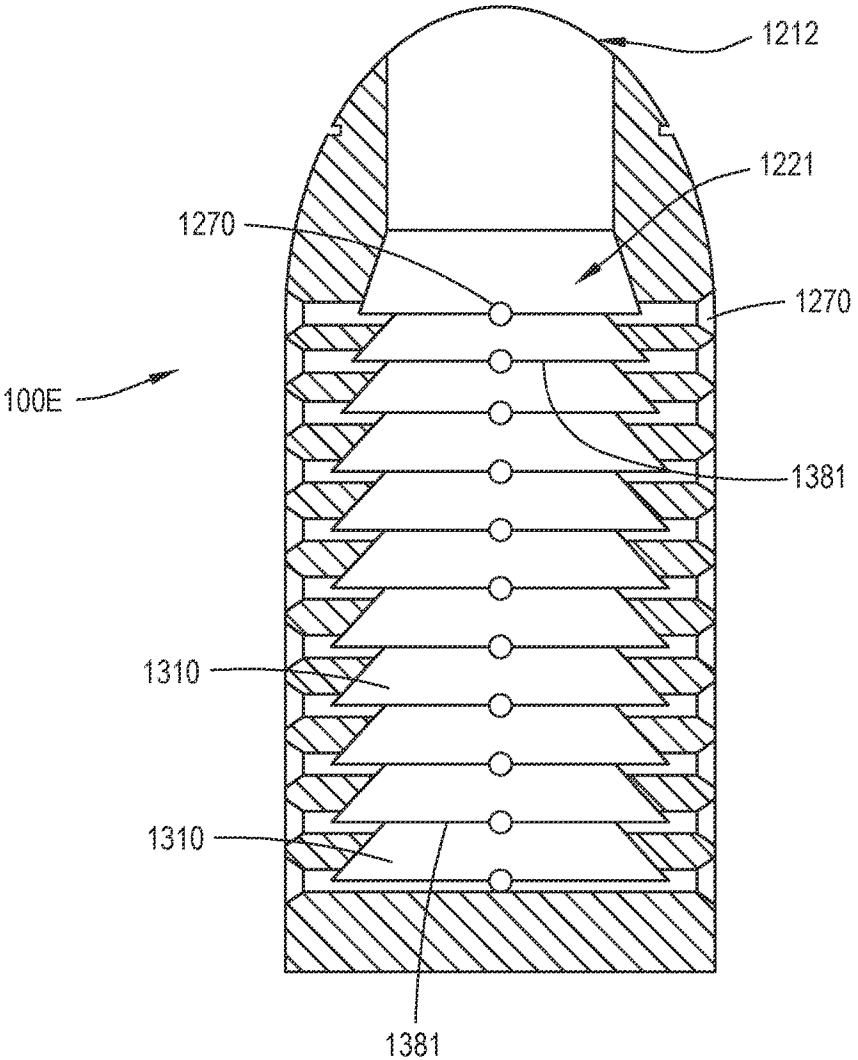
Figure 14B:
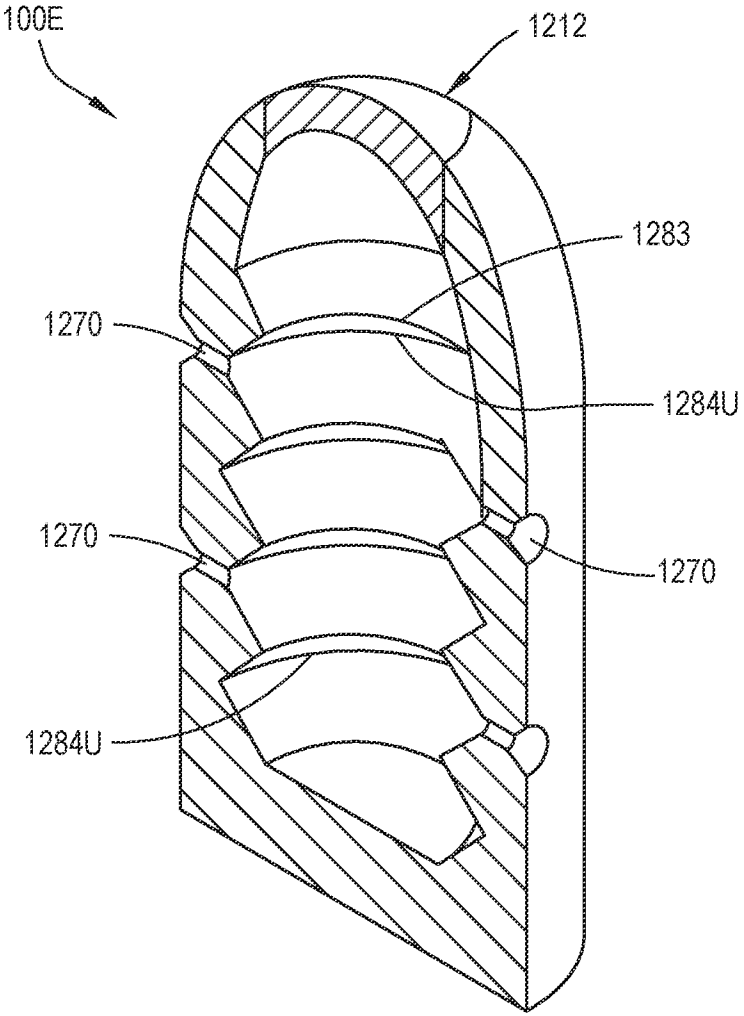
Figure 14A:
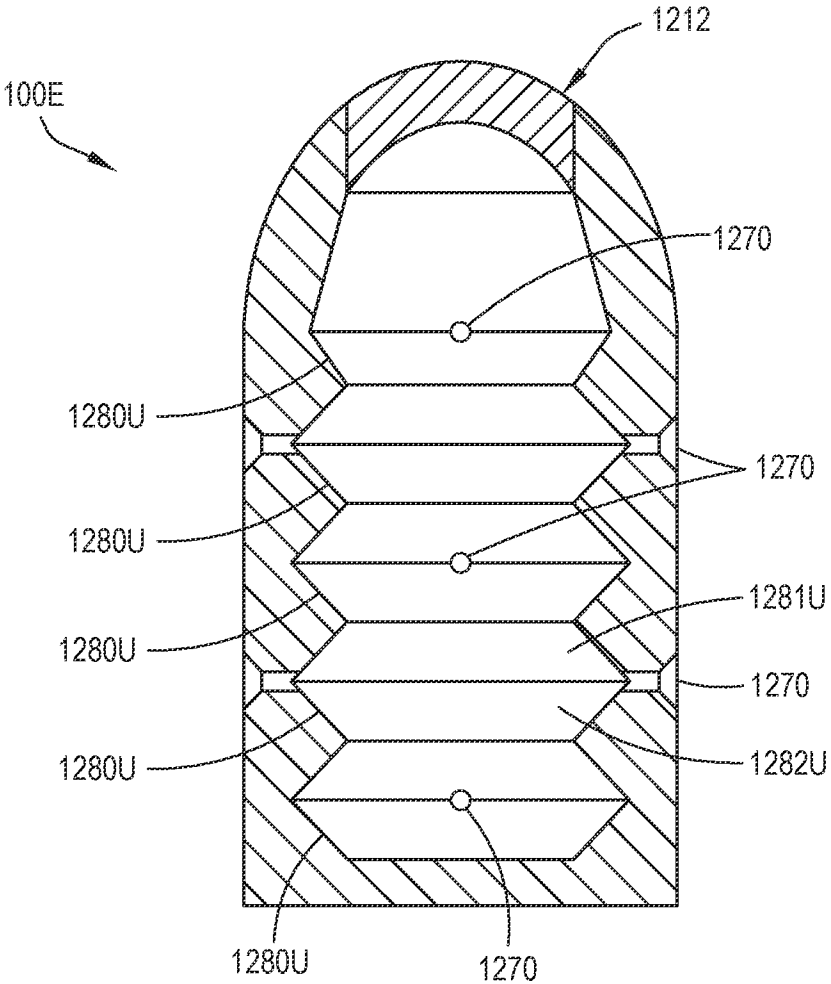

FIG. 9 is a schematic illustration of a separation of the mass reducing projectile of FIG. 8 into its constituent parts in accordance with aspects of the present disclosure;

FIG. 10A is a schematic illustration of a mass reducing projectile in accordance with aspects of the present disclosure;

FIG. 10B is a schematic illustration of an ejection of portions of the mass reducing projectile of FIG. 10A in accordance with aspects of the present disclosure;

FIG. 11A is a schematic illustration of a mass reducing projectile in accordance with aspects of the present disclosure;

FIG. 11B is a schematic base end view illustration of the mass reducing projectile of FIG. 11A in accordance with aspects of the present disclosure;

FIG. 11C is a schematic illustration of an ejection of portions of the mass reducing projectile of FIG. 10A in accordance with aspects of the present disclosure;

FIG. 12A is a schematic plan illustration of a mass reducing projectile in accordance with aspects of the present disclosure;

FIG. 12B is a perspective illustration of the mass reducing projectile of FIG. 12A in accordance with aspects of the present disclosure;

FIG. 12C is a plan cross-sectional illustration of the mass reducing projectile of FIG. 12A in accordance with aspects of the present disclosure;

FIG. 12D is a perspective cross-sectional illustration of the mass reducing projectile of FIG. 12A in accordance with aspects of the present disclosure;

FIG. 12E is a cross-sectional illustration of the mass reducing projectile of FIG. 12A in accordance with aspects of the present disclosure;

FIG. 12F is a cross-sectional illustration of the mass reducing projectile of FIG. 12A in accordance with aspects of the present disclosure;

FIG. 13A is a plan cross-sectional illustration of the mass reducing projectile of FIG. 12A in accordance with aspects of the present disclosure;

FIG. 13B is a perspective cross-sectional illustration of the mass reducing projectile of FIG. 13A in accordance with aspects of the present disclosure;

FIG. 14A is a plan cross-sectional illustration of the mass reducing projectile of FIG. 12A in accordance with aspects of the present disclosure; and FIG. 14B is a perspective cross-sectional illustration of the mass reducing projectile of FIG. 14A in accordance with aspects of the present disclosure.

DETAILED DESCRIPTION

Figure 1:
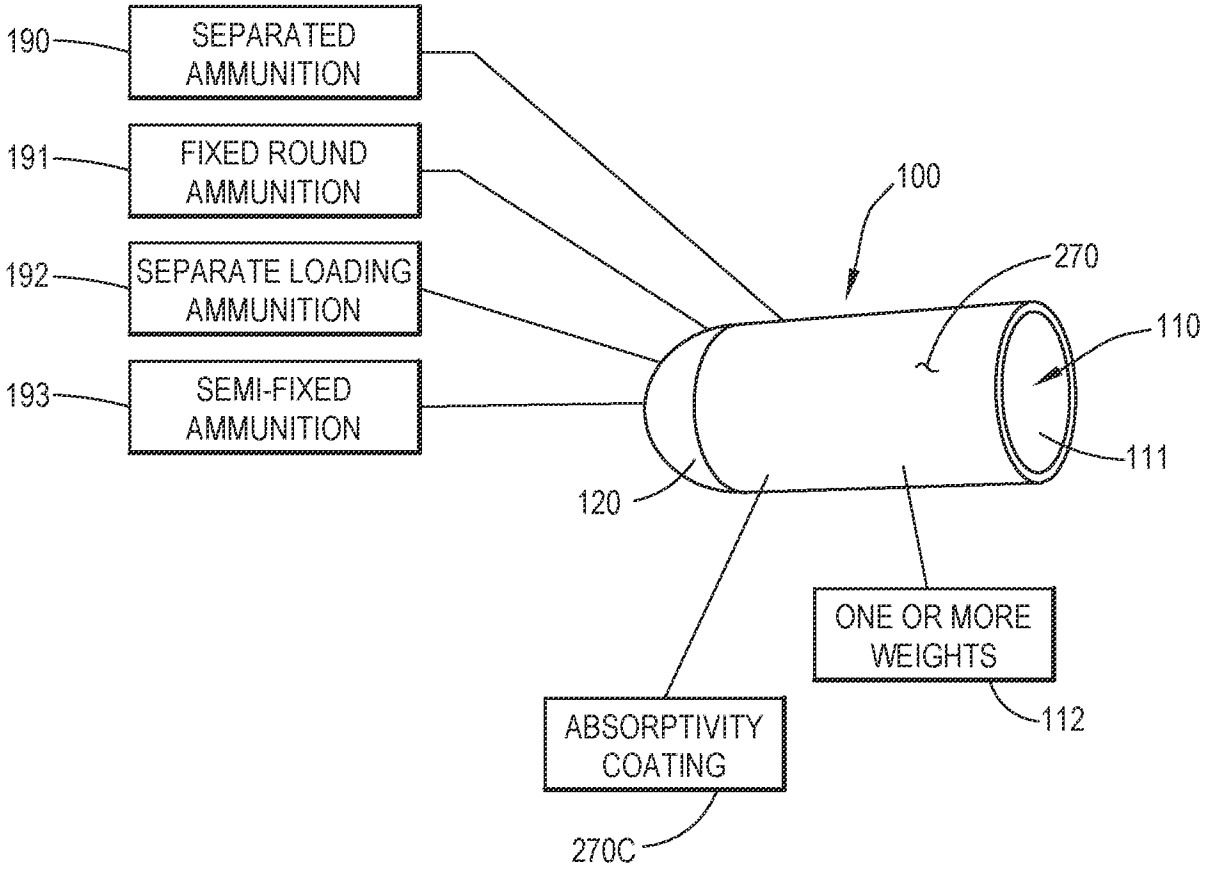
Figure 2:
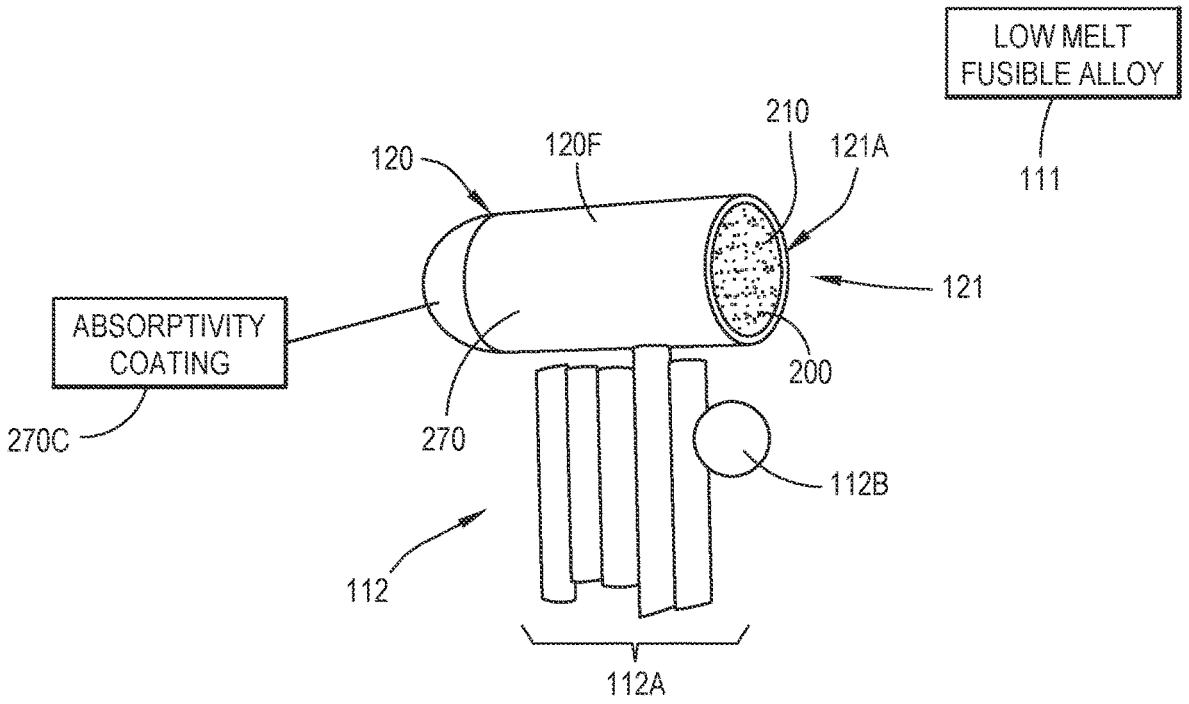

Referring to FIGS. 1 and 2, the aspects of the present disclosure described herein are intended to solve the problems noted above among other issues. In particular, the present disclosure provides mass reducing projectile 100, 100A, 100B, 100C, 100D, 100E (also referred to herein as projectile 100, 100A, 100B, 100C, 100D, 100E) with a self-reducing mass. The projectile 100, 100A, 100B, 100C, 100D, 100E sheds or otherwise reduces its mass in (i.e., during) flight.

Shedding or reduction in mass of the projectile 100, 100A, 100B, 100C, 100D, 100E occurs when the projectile 100, 100A, 100B, 100C, 100D, 100E is exposed to one or more of ambient environmental conditions, spin stabilized rotational velocities, and/or corrosive/destructive chemical agents. The reduction in mass of the projectile 100A, 100B, 100C, 100D, 100E is effected by separating the projectile 100, 100A, 100B, 100C, 100D, 100E into separate and distinct parts during flight, where each of the separate and distinct parts (referred to herein as constituent parts) of the projectile 100, 100A, 100B, 100C, 100D, 100E after shedding or mass reduction is no larger than about 10% to about 15% the total pre-flight mass of the projectile 100, 100A, 100B, 100C, 100D, 100E.

The mass reduction of the projectile 100, 100A, 100B, 100C, 100D, 100E into pieces that are each no larger than about 10% to about 15% the total pre-flight mass of the projectile 100, 100A, 100B, 100C, 100D, 100E is completed in flight (e.g., during flight) and prior to the projectile 100, 100A, 100B, 100C, 100D, 100E impacting the ground due to at least gravitational forces acting on the projectile 100, 100A, 100B, 100C, 100D, 100E.

For example, a rise in temperature of a core 110 of the projectile effected by, for example, solar radiation (and/or friction heating between the projectile and ambient atmosphere) causes at least a portion of the core 110 to melt so that core material exits a shell 120 of the projectile 100. Each of the constituent parts of the projectile 100 after shedding or mass reduction is no larger than 10% to about 15% the total pre-flight mass of the projectile 100.

Figure 7:
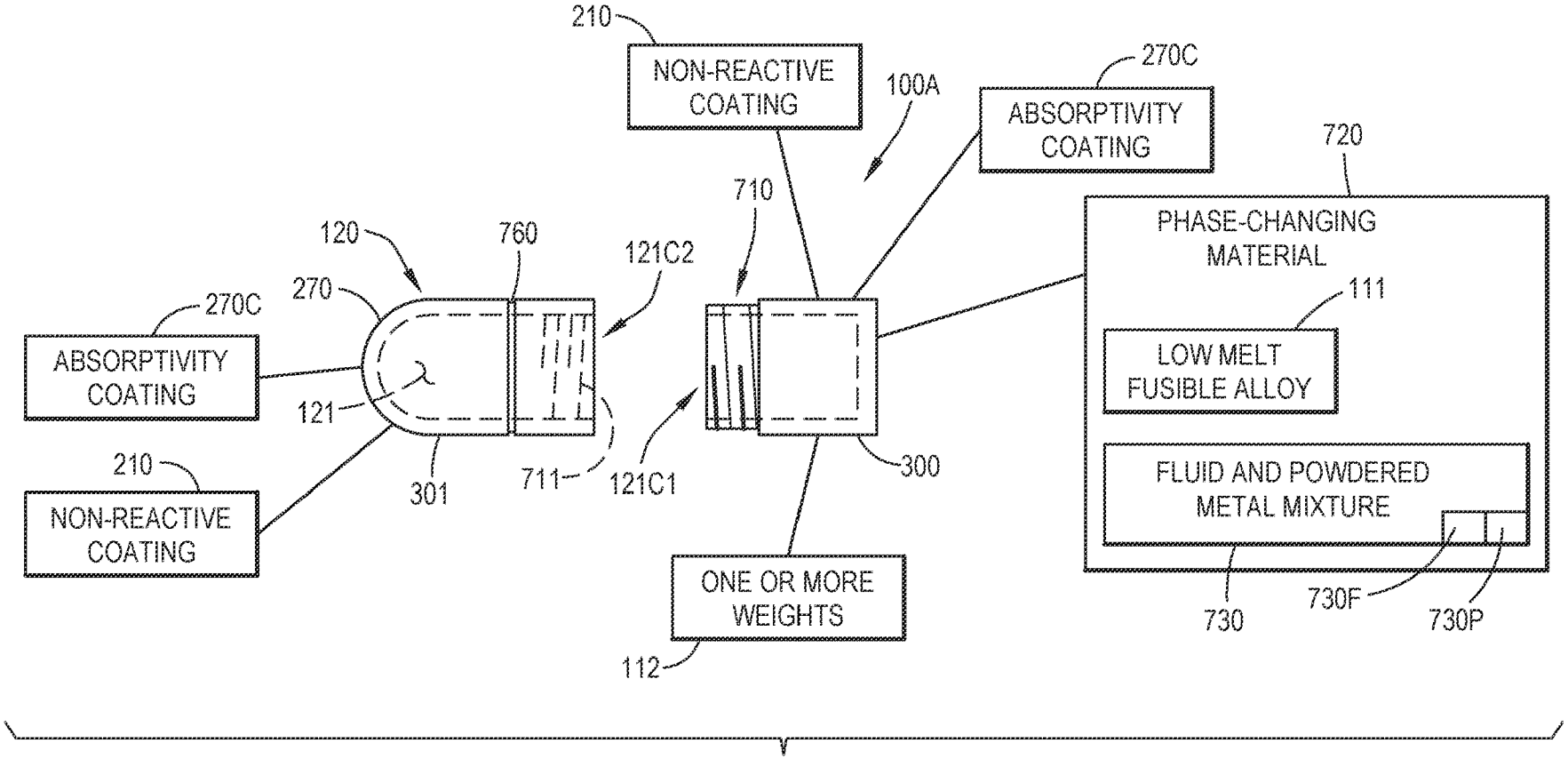

In other aspects, the reduction in the mass of the projectile 100A is effected by an increase in temperature of the projectile 100A (FIG. 7). For example, a heating of the projectile 100D (FIGS. 11A and 11B) may be implemented so that the projectile melts during flight.

Optionally or additionally, the reduction in the mass of the projectile 100A may be effectuated by an increase in internal pressure within an internal cavity of the projectile 100A, an amount of exposure of the projectile 100C (FIG. 10A) to ultraviolet light, an exposure of the shell 120 of the projectile 100B (FIG. 8) to a corrosive material or chemical agent 820 as described herein, For example, a mechanical shedding of mass effected by a spin stabilized rotational velocity of the projectile 100E (FIGS. 12A-12D) as described herein. In accordance with the present disclosure, the projectile 100, 100A, 100B, 100C, 100D, 100E is a spin stabilized projectile and in one or more aspects centrifugal force acting on the core material resulting from the spin stabilized rotation of the projectile 100, 100A, 100B, 100C, 100D, 100E about a geometrical axis of rotation 400 (see FIG. 6) of the projectile 100, 100A, 100B, 100C, 100D, 100E causes ejection of the core material radially outward from the shell 120. The geometric axis of rotation 400 is coincident with the center of mass rotational axis 401 (see FIG. 4B) so as to maintain spin stabilized flight along a predictable flight trajectory (e.g., so that the projectile does not have an eccentric axis of rotation).

Figure 1A:
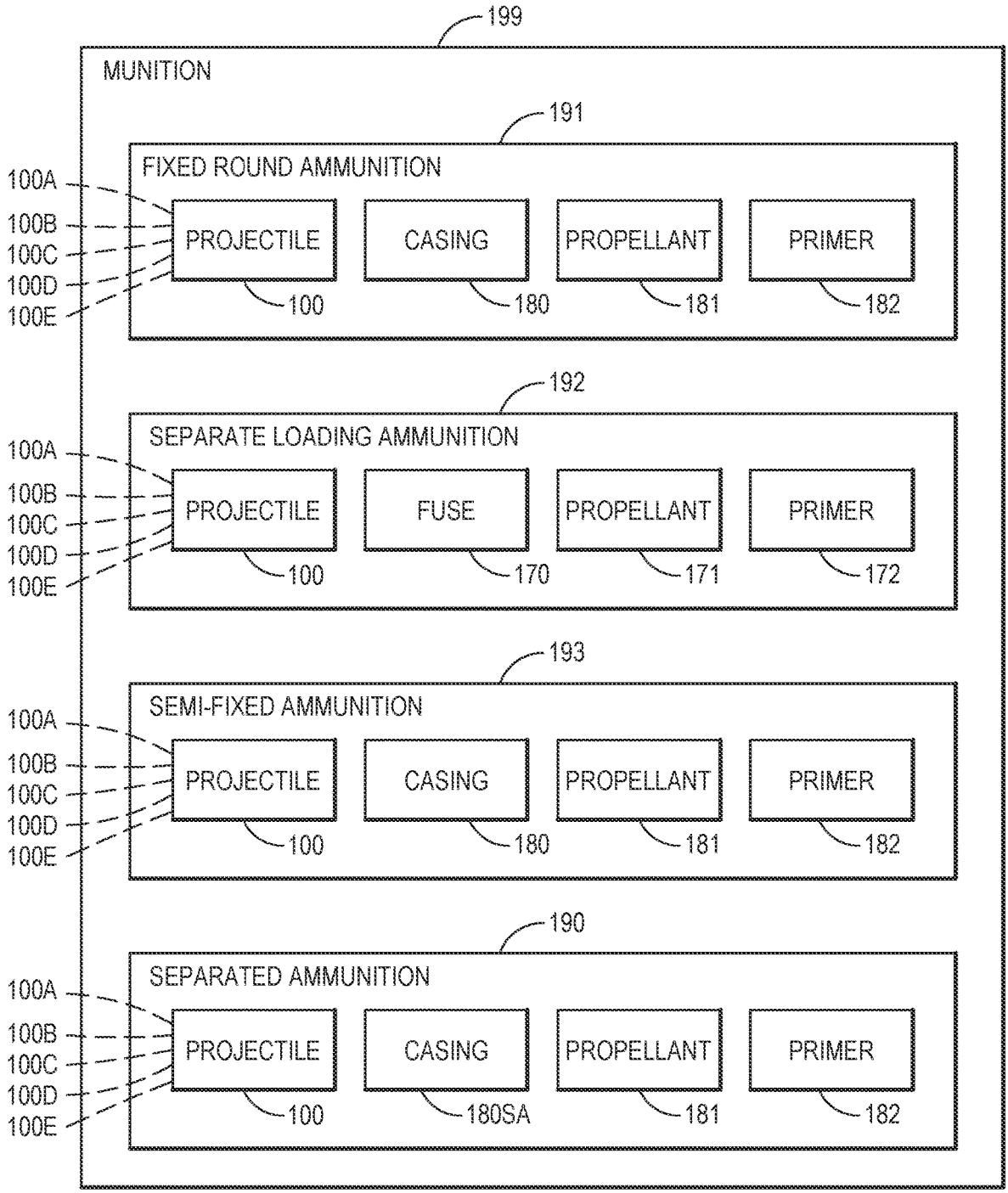
Figure 1B:
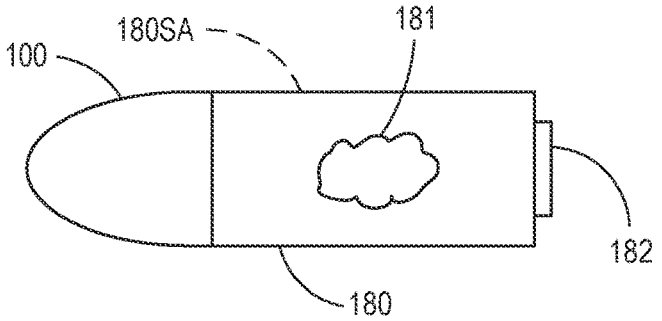

While the aspects of the present disclosure are described herein with respect to a bullet type projectile travelling at subsonic or supersonic velocities, it should be understood that the aspects of the present disclosure can be applied to any suitable kinetic energy device that employs a projectile. For example, referring to FIGS. 1 and 1A the aspects of the present disclosure are employed in one or more of small caliber guns/arms munitions or large caliber artillery/cannon munitions (generally referred to as munitions or when referred to singularly a munition 199). For example, in one or more aspects, the projectile 100, 100A, 100B, 100C, 100D, 100E is part of a "cased ammunition" or "fixed round ammunition" 191 that includes the projectile 100, 100A, 100B, 100C, 100D, 100E, a casing 180, a propellant 181, and a primer 182 (also referred to herein as an igniter) where the casing is crimped (fixed) to the projectile 100, 100A, 100B, 100C, 100D, 100E. Here the projectile 100, 100A, 100B, 100C, 100D, 100E is fired from the casing 180 where the propellant 181 (also referred to as a charge) is ignited by the primer 182 and the projectile 100, 100A, 100B, 100C, 100D, 100E is expelled from the casing 180 and down a bore of a gun barrel.

In other aspects, the projectile 100, 100A, 100B, 100C, 100D, 100E is a component of "separate loading ammunition" 192 which has four separate components: a primer 172 (also referred to as an igniter), a propellant 171, a projectile 100, 100A, 100B, 100C, 100D, 100E, and a fuse 170. Here, the four components are issued separately and upon preparation for firing, the projectile 100, 100A, 100B, 100C, 100D, 100E and propellant are loaded into the artillery in two separate operations.

In still other aspects, the projectile 100, 100A, 100B, 100C, 100D, 100E described herein is employed in "semi-fixed ammunition" 193 (the casing 180 and the projectile 100, 100A, 100B, 100C, 100D, 100E still fit together, but the casing 180 can be removed to adjust the amount of the propellant 181) and/or "separated ammunition" 190 (where the casing is not attached to the projectile 100, 100A, 100B, 100C, 100D, 100E at all and the casing 180SA is closed with a plug to protect the propellant and assist with pushing the projectile 100, 100A, 100B, 100C, 100D, 100E into the chamber of the gun). The structural/positional relationships between the components of the fixed round ammunition 191, the separate loading ammunition 192, the semi-fixed ammunition 193, and the separated ammunition 190 are known to those skilled in the art and are not described in further detail herein.

Referring to FIGS. 1-4B, in one or more aspects the projectile 100 includes a shell 120 and a core 110. The core 110 includes one or more weights 112 and a low melt fusible alloy 111. The shell 120 includes a frame 120F that forms an internal cavity 121 that has a pass-through aperture 121A at one end. The internal cavity 121 at least partially houses the core 110 (as in some aspects the low melt fusible alloy 111 forms a portion of the projectile base) as described herein. The one or more weights 112 are any suitable weights being shaped and sized for insertion into the internal cavity 121, where the one or more weights increase a mass and/or stiffness of the projectile 100 (compared to a mass and/or stiffness of the projectile 100 with only the shell 120 and low melt fusible alloy 111).

For example, the one or more weights 112 include one or more rods 112A and/or spheres 112B (e.g., ball bearings, BBs, etc.) that with the shell 120 and low melt fusible alloy 111 provide the projectile with any suitable predetermined mass. With the one or more weights 112 inserted into the internal cavity 121, the low melt fusible alloy 111 is poured into the internal cavity 121 so as to fill the internal cavity 121 and encase the one or more weights within the internal cavity 121 as illustrated in FIG. 1.

Figure 3:
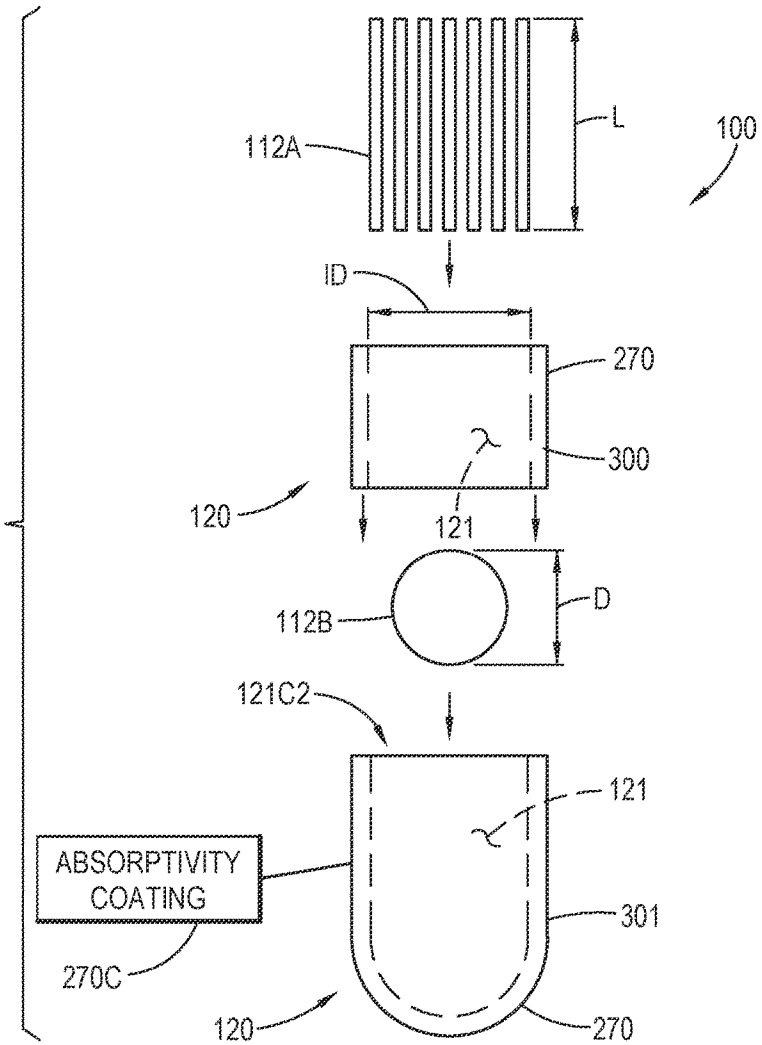

In FIGS. 1 and 2 the shell 120 is illustrated as a single piece or unitary member; however, in other aspects the shell 120 is segmented and includes more than one shell section or segment as illustrated in FIG. 3. For example, the shell 120 includes two segments, which segments are a front segment 301, and a base or rear segment 300. The front segment 301 forms a closed end section of the internal cavity 121 (shown with dashed lines in FIG. 3) while the rear segment 300 is a cylindrical tube that forms an open end section of the internal cavity 121 through which the one or more weights 112 and low melt fusible alloy 111 are inserted into the shell 120. The front segment 301 and rear segment 300 are held together at least in part by the low melt fusible alloy 111; while in other aspects any suitable mechanical or chemical coupling (as described herein) is also employed to couple the front segment 301 and rear segment 300 to each other.

In one or more aspects, the one or more rods 120A disposed within the internal cavity 121 also provide structural alignment and rigidity to the front segment 301 and the rear segment 300 prior to and after inserting the low melt fusible alloy into the internal cavity 121.

In one or more aspects, the shell 120 is constructed of any suitable metal or alloy including but not limited to brass, bronze, aluminum, steel, tungsten or any other metal/alloy having a melting point above a melting point of the low melt fusible alloy 111. In one or more aspects, the shell is constructed of a low melt fusible alloy that is the same as the low melt fusible alloy 111 or a different type of low melt fusible allow that has a higher or lower melting temperature than the low melt fusible alloy 111. In one or more aspects, the shell is constructed (such as, e.g., molded) of a powdered metal 1001 and adhesive 1010 mixture such as that described herein with respect to FIGS. 10A and 10B. The one or more weights 112 are constructed of any suitable metal that increases the mass and/or stiffness of the projectile 100. For example, the one or more weights 112 are constructed of brass, bronze, aluminum, steel, tungsten, etc. The low melt fusible alloy is any suitable alloy with a low melting point (e.g., below about 450 degrees Fahrenheit) such as, for exemplary purposes only, Field's metal, Wood's metal, Rose's metal, Cerrolow® (or Bolton) 117, Cerrolow® (or Bolton) 136, Cerrolow® (or Bolton) 174, Cerrosafe®, and any suitable Bismuth alloys.

Figure 4A:
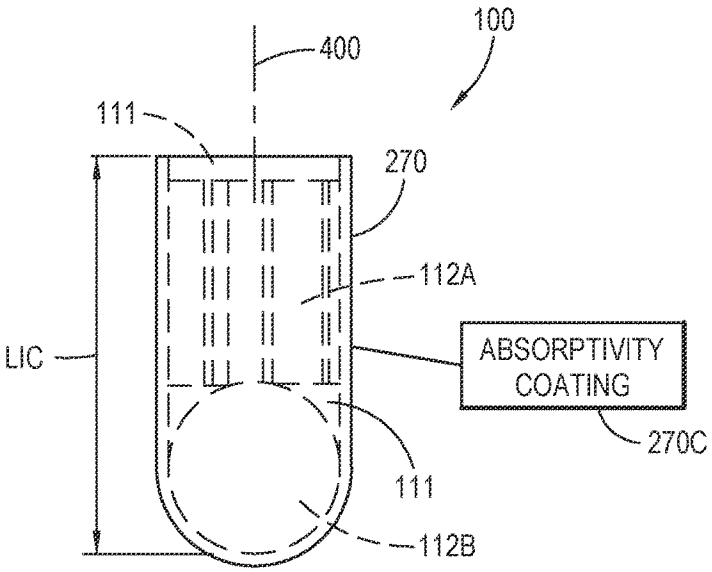
Figure 4B:
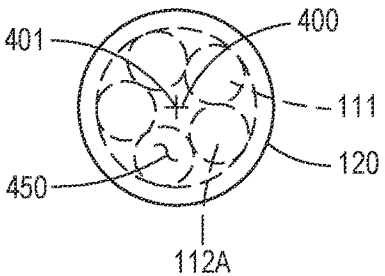
Figure 5:
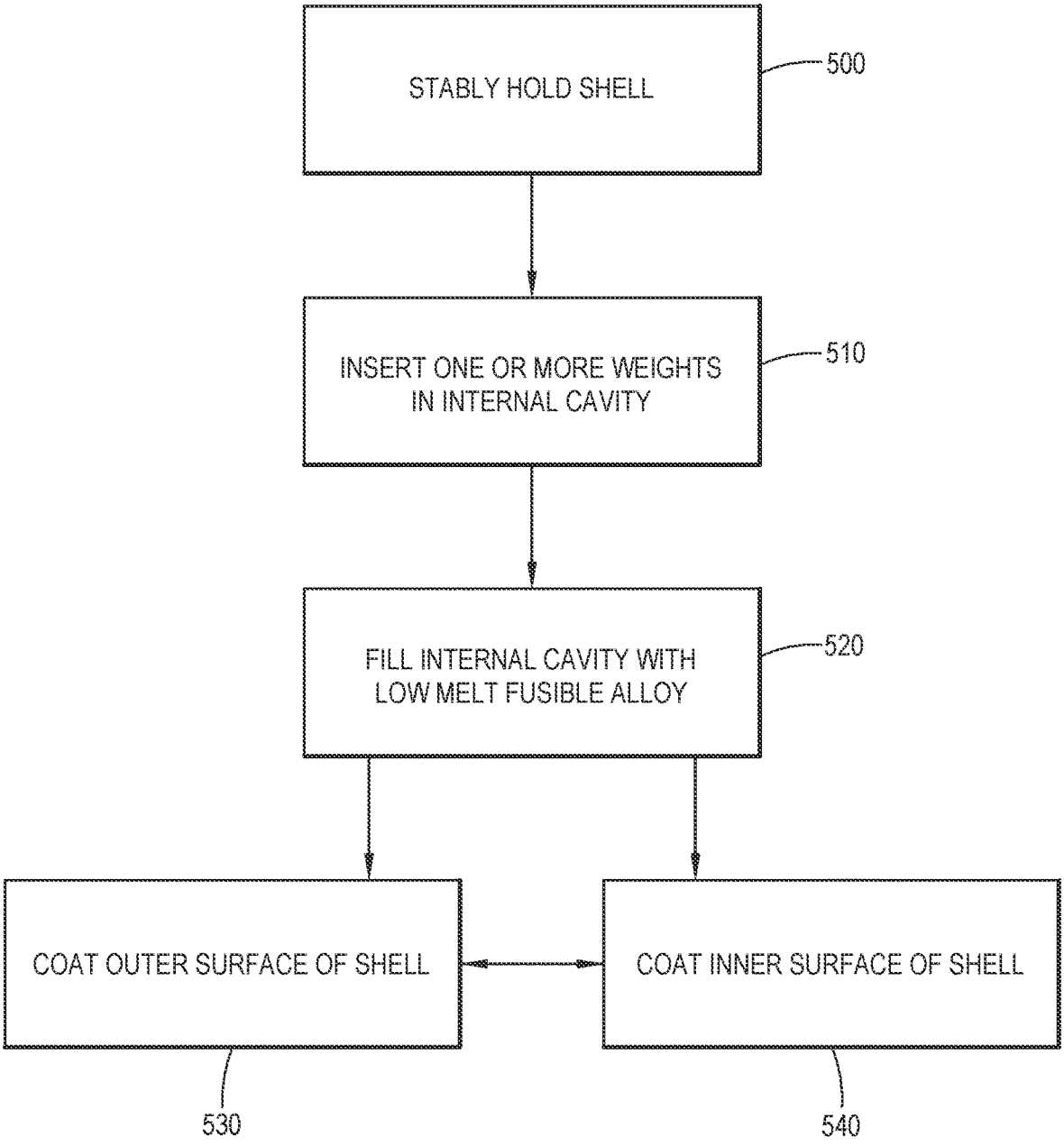

Referring still to FIGS. 3, 4A, and 4B, and also to FIG. 5, and a method of assembling the projectile 100 will be described. The shell 120 is placed in any suitable fixture so as to stably hold the shell 120 (FIG. 5, Block 500). The one or more weights 112 are inserted into the internal cavity 121 of the shell 120 (FIG. 5, Block 510). Where both the one or more rods 112A and sphere(s) 112B are utilized the sphere (s) 112B are inserted into the internal cavity prior to insertion of the one or more rods 112A. Here the sphere has a diameter D that substantially conforms with the diameter ID of the internal cavity 121 (e.g., so that the sphere 112B freely falls within the internal cavity 121 and is substantially centered within the internal cavity 121 along a geometric axis of rotation 400 (FIGS. 4A and 4B) of the projectile 100. The one or more rods have a length L that is substantially equal to the length LIC of the internal cavity 121 minus the diameter D of the sphere 112B. The low melt fusible alloy 111 is poured into the internal cavity 121 through the pass-through aperture 121A so as to fill the internal cavity and substantially encase the one or more weights 112 within the internal cavity 121 (i.e., the low melt fusible alloy 111 forms, at least in part, a base of the projectile 100 as illustrated in FIGS. 1, 4A, and 4B) (FIG. 5, Block 520).

In one aspect, the shell 120 is spun around its geometric axis of rotation 400 during insertion or after insertion of the one or more weights 112 to position or settle the one or more weights within the internal cavity 121 about the geometric axis of rotation 400 so that the projectile is spin balanced about the geometric axis of rotation 400 (e.g., the center of mass of the projectile lies substantially along and is coincident with the geometric axis of rotation 400). The shell 120 may also be rotated and/or vibrated as the low melt fusible alloy 111 is poured into the internal cavity 121 so as to fill any voids that may exist between adjacent weights of the one or more weights 112 and/or between the one or more weights 112 and a surface 200 (FIG. 2) of the internal cavity 121.

In one or more aspects, the surface 200 of the internal cavity 121 is coated with any suitable non-reactive coating 210 configured to substantially prevent chemical interaction between the material of the shell 120 and at least the low melt fusible alloy 111 within the internal cavity 121 (FIG. 5, Block 540). The non-reactive coating 210 is one or more of brass, bronze, copper or any other suitable material that is substantially non-reactive with the low melt fusible alloy 111. The non-reactive coating 210 is deposited on the surface 200 in any suitable manner such as plating or spraying.

As described above, the projectile 100 is heated by ambient conditions during flight of the projectile 100. The projectile 100 has an outer surface 270, as shown in FIG. 1, with an absorptivity of about 0.1 or greater. To increase the absorptivity of the projectile, the outer surface 270 is coated with an absorptivity coating 270C so as to have a dark color, such as, but not limited to, black. The outer surface 270 is coated with the absorptivity coating 270C, such as an anodized coating or other hard coating process, a spray deposited coating (paint, die, etc.), so that the outer surface 270 has any suitable color (e.g., black, blue, brown, or any other dark color) to effect an absorptivity of the projectile 100 that increases the temperature of the projectile during flight of the projectile 100 to above the melting point/temperature of the low melt fusible alloy 111 (FIG. 5, Block 530).

Figure 6:
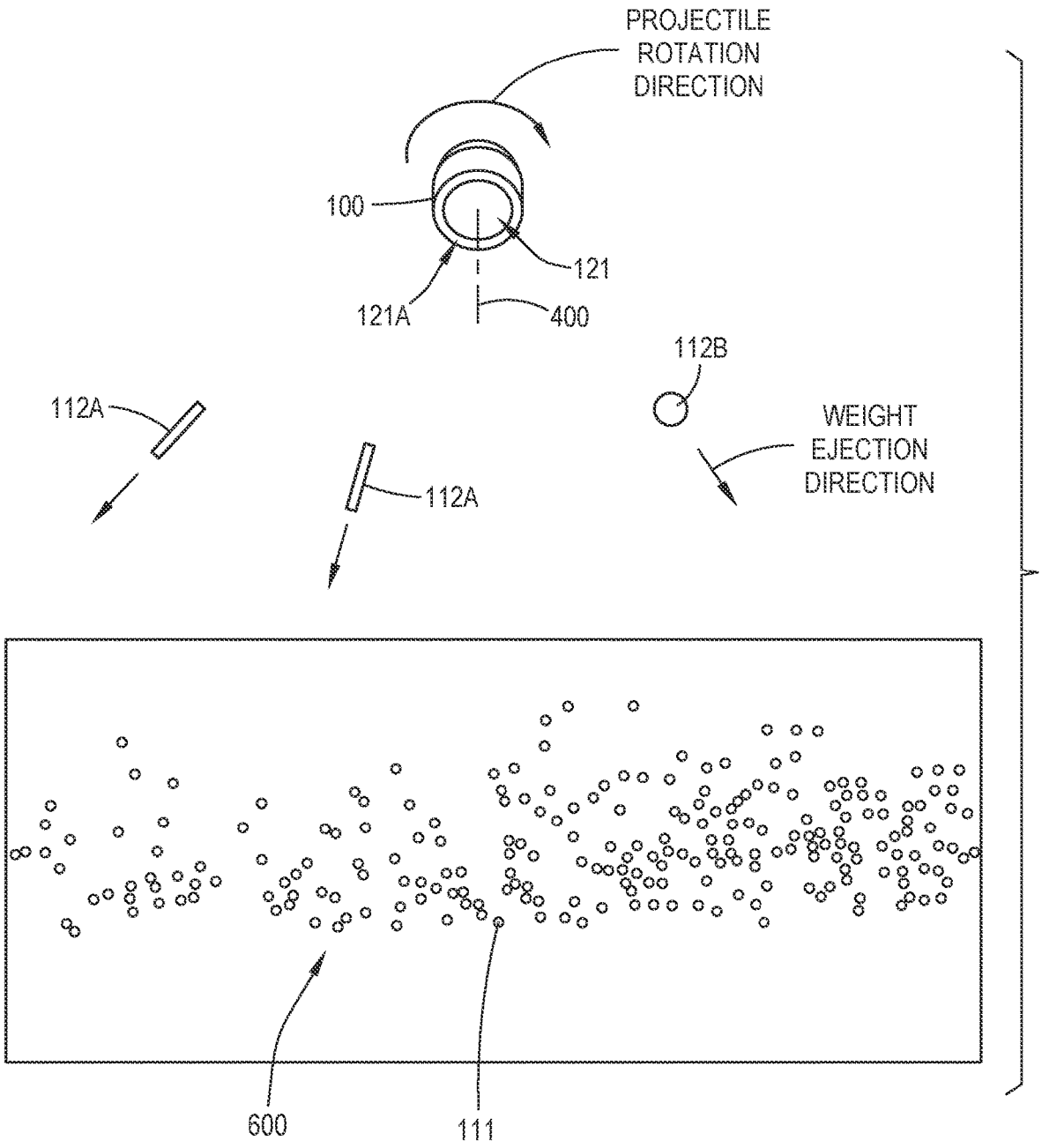

Referring also to FIG. 6, as the projectile 100 is in flight, solar energy and/or frictional energy is absorbed as heat by the projectile 100 so as to increase the temperature of the core 110 to a temperature above the melting temperature of the low melt fusible alloy 111. Here, for exemplary purposes, the low melting point fusible alloy 111 is Field's metal having a melting temperature of about 142° F. With the core 110 temperature at or above 142° F., the low melt fusible alloy 111 melts and is ejected (as can be seen in FIG. 6) from the internal cavity 121 through the pass-through aperture 121A due to centrifugal forces of the spin stabilized projectile 100 rotation about the geometric axis of rotation 400. Ejection of the low melt fusible alloy 111 releases the one or more weights 112 (such as the one or more rods 112A and/or spheres 112B) from the internal cavity 121 such that the weights are also ejected. It is noted that ejection of the low melt fusible alloy 111 and the one or more weights 112 may destabilize the rotation of the shell 120 where the destabilization effects slowing the forward velocity of the shell 120 and further facilitates ejection of the low melt fusible alloy 111 and the one or more weights 112.

While the above is an example of the self-reduction in mass of the projectile 100 in flight, where the self-reduction in mass is effected by heating (e.g., to at least a melting temperature of the low melt fusible alloy, which temperature may be above or below the freezing temperature of water) of the projectile 100 in flight so that the low melt fusible alloy is ejected from the shell 120 and the one or more weights 112 are released, in other aspects the self-reduction in mass of the projectile 100 is effected chemically or with an increase in pressure within the internal cavity 121.

For example, referring to FIG. 7, the projectile 100A includes a shell 120 substantially similar to that described above and a phase-changing material 720. In one or more aspects, the projectile 100A also includes one or more weights 112 within the internal cavity 121. The shell 120 is illustrated as having front segment 301 and rear segment 300; however, in this aspect the rear segment 300 forms a rear internal cavity 121C1, shown in dashed lines in FIG. 7, which is open on only one end of the rear segment 300 (i.e., the end that couples with the front segment 301).

The front segment 301 is substantially similar to that described above and includes a front internal cavity 121C2 shown in dashed lines in FIGS. 3 and 7. The rear segment 300 is coupled to the front segment 301 so that the front internal cavity 121C2 and the rear internal cavity 121C1 form the internal cavity 121 of the shell 120. In this aspect the internal cavity 121 is a sealed cavity. In this aspect the front segment 301 includes a groove or score line 760 that delineates a fracture/burst (i.e., separation) location of the shell 120 that separates the projectile 100A into two or more pieces (i.e., the two or more pieces including the front segment 301, the rear segment 300 or combined portions of both the front segment 301 and the rear segment 300); however, in other aspects the score line 760 is disposed on the rear segment 300 in a manner similar to that described herein. Each of the two or more pieces (e.g., each ejected piece of the phase-changing material 720, each of the one or more weights (if employed), the front segment 301, and the rear segment 300) is less than about 10% to about 15% of a total pre-flight mass of the mass reducing projectile.

The front segment 301 and the rear segment 300 are coupled to each other in any suitable manner, such as by press fit, threading, bonding, etc. In the example, illustrated in FIG. 7 the rear segment 300 includes male threads 710 that are threaded into corresponding female threads 711 of the front segment 301 for coupling the front segment 301 to the rear segment 300.

Any suitable phase-changing material 720 (e.g., solid to liquid phase change or liquid to gas phase change) is inserted into the front internal cavity 121C2 of the front segment 301 and/or into the rear internal cavity 121C1 of the rear segment 300. The phase-changing material 720 is in one aspect the low melt fusible alloy 111 described above. In other aspects, the phase-changing material 720 is a fluid and powdered metal mixture 730 such as a mixture of ammonium and tungsten (although any suitable fluid and/or powdered metal may be used).

As describe above, in one or more examples, the one or more weights 112 are also inserted into the one or more of the front segment 301 and rear segment 300 so as to be spin balanced in the manner described above. The phase-changing material 720 is poured into the internal cavity 121 (formed by the front internal cavity 121C2 and the rear internal cavity 121C1). Where the one or more weights 112 are employed with the phase-changing material 720 the phase-changing material is poured over and around the one or more weights in a manner substantially similar to that described above. The front segment 301 and the rear segment 300 (which rear segment 300 may be a mere cap on the front segment 301) are coupled to each other, as noted above, so as to form the projectile 100A.

In the aspect illustrated in FIG. 7, the projectile 100A is heated as described above (e.g., such as with solar energy and/or friction energy) so that the increase in projectile 100A temperature causes the phase-changing material 720 to change phase. The change in phase of the phase-changing material 720 increases a volume of the phase-changing material 720 effecting and increase a pressure within the internal cavity 121 and a separation of at least a portion of one of the front segment 301 and the rear segment 300 from another of the front segment 301 and the rear segment 300 (e.g., a separate along the score line 760).

For example, where the low melt fusible alloy 111 is employed, the increased temperature of the projectile causes a melting of the low melt fusible alloy within the internal cavity 121. As the low melt fusible alloy 111 melts, the low melt fusible alloy 111 expands (e.g., increases in volume) so as to increase a pressure on the surface 200 (FIG. 2) of the internal cavity 121. This increased pressure on the surface 200 causes the shell 120 to fracture or burst at the score line 760 so that the projectile breaks substantially into its constituent parts (e.g., the front segment 301, the rear segment 300, the low melt fusible alloy, and if employed the one or more weights 112) with the low melt fusible alloy 111 (and where employed, the one or more weights 112) being ejected from the internal cavity 121 in the manner described above with respect to FIG. 6.

Still referring to FIG. 7, where the phase-changing material 720 is the fluid and powdered metal mixture 730, the increased temperature of the projectile causes the fluid 730F to vaporize. As the fluid 730F vaporizes the pressure on the surface 200 (FIG. 2) of the internal cavity 121 increases. This increased pressure on the surface 200 causes the shell 120 to fracture or burst at the score line 760 so that the projectile breaks substantially into its constituent parts (e.g., the front segment 301, the rear segment 300, the fluid 730F, the powdered metal 730P, and if employed the one or more weights 112) with the fluid 730F, the powdered metal 730P, and where employed, the one or more weights 112 being ejected from the internal cavity 121 in the manner described above with respect to FIG. 6. As noted above, each of the constituent parts is less than about 10% to 15% of the total pre-flight mass of the projectile 100A.

In one or more aspect, such as where the front segment 301 and the rear segment 300 of the projectile 100A are press fit together or bonded together, the score line 760 may not be provided on the shell 120. For example, the increase in pressure within the internal cavity 121 as a result of the change in phase (e.g., solid to liquid or liquid to gas) of the phase-changing material is greater than a retention force of the press fit or bond between the front segment 301 and the rear segment 300. Here, the increased pressure within the internal cavity 121 causes a separation of the front segment 301 and the rear segment 300 at the coupling between the front segment 301 and the rear segment 300.

Referring to FIGS. 8 and 9, the projectile 100B is configured to separate into its constituent parts through a corrosion of the shell 120. In this aspect, the projectile 100B is illustrated as a component of a fixed round ammunition 191 for exemplary purposes only; however, in other aspects, the projectile 100 is a component of any one of the separate loading ammunition 192, the semi-fixed ammunition 193, and the separated ammunition 190.

The projectile 100B includes a shell 120 having a frame 120F forming an internal cavity 121, and a base 120B coupled to the frame 120F and configured to seal the internal cavity 121. The projectile 100B also includes an inert vessel 810 having a chemical agent 820 sealed within the inert vessel 810, and a protrusion 801 extending from the base 120B towards the inert vessel 810. The protrusion 801 is configured to break the inert vessel 810 so as to release the chemical agent 820 within the internal cavity 121. The inert vessel 810 is disposed within the internal cavity 121 so that upon breaking of the inert vessel 810 the chemical agent 820, which is configured to corrode the shell 120, corrodes the shell 120 so as to separate the shell 120 into two or more pieces. Each of the two or more pieces is less than about 10% to about 15% of the total pre-flight mass of the projectile 100B.

The inert vessel 810 is, for example, a glass container; however, in other aspects the inert vessel is any suitable vessel constructed of a material that does not react to the chemical agent held within the inert vessel 810. The chemical agent 820 is any suitable chemical configured to corrode the shell 120 during flight of the projectile 100B. For example, the chemical agent 820 is gallinstan 822 or any suitable acid 821 that will corrode the shell 120 and separate the shell 120 into two or more pieces while the projectile 100B is in flight. The chemical agent 820 is released from the inert vessel 810 by the protrusion 801 under impetus of the ignited propellant 181.

For example, ignition of the propellant 181 increases the pressure within the casing 180. In one aspect, the protrusion 801 is a pin extending through the base 120B, where the protrusion 801 is configured to move relative to the base 120B towards the inert vessel 810 so as to contact and break the inert vessel 810. For example, the pin 810 has a surface area exposed to the ignited propellant so that the pressure increase within the casing 180 pushes the protrusion 801 towards inert vessel 810 so as to break the inert vessel 810 and release the chemical agent 820. As another example, the protrusion 801 is integral with the base 120B and the base is configured to deform (e.g., under the impetus of the increased pressure within the casing 180 from the ignited propellant) so that the protrusion 801 moves towards the inert vessel 810 so as to contact and break the inert vessel 810, releasing the chemical agent 820.

In one or more aspects, the projectile 100B illustrated in FIGS. 8 and 9 includes the one or more weights 112. The one or more weights 112 are disposed within the internal cavity 121 and are configured to be ejected from the internal cavity 121 (in a manner similar to that described above) upon separation of the shell 120 into the two or more pieces 900, 901. Here, each of the two or more pieces 900, 901 and each of the one or more weights is less than about 10% to about 15% of a total pre-flight mass of the projectile 100B.

Referring to FIGS. 10A and 10B, in another aspect, the projectile 100C includes a body 1020. The body comprises a powdered metal 1001 and an adhesive 1010 configured to bind the powdered metal into a predetermined shape, such as an aerodynamic shape similar to any conventional projectile. The adhesive 1010 is configured to degrade during flight of the projectile 100C so that at least a portion 1050 of the powdered metal 1001 (which may include adhesive 1010) is unbound from the body 1020 and is ejected from the body 1020 so as to reduce the projectile 100C to a reduced mass that is less than a total pre-flight mass of the projectile 100C.

The adhesive 1010 is any suitable adhesive that is configured to degrade upon exposure to ultraviolet radiation, wherein degradation of the adhesive 1010 at least in part effects unbinding of the portion 1050 of the powdered metal 1001 from the body 1020 during flight of the projectile 100C. In one aspect, the adhesive is an epoxy 1011. The powdered metal is any suitable metal such as, but not limited to, tungsten 1002. In this aspect, each portion 1050 of the powdered metal 1001 that is unbound from the body 1020 is less than about 10% to about 15% of the total pre-flight mass of the projectile 100C. In one or more aspects, the projectile 100C includes a reinforcing matrix core 1130 in a manner similar to that described below with respect to FIGS. 11A and 11B, where the powdered metal 1001 and adhesive 1010 mixture is disposed around and through the reinforcing matrix core 1130.

As with the other aspects described herein, the body 1020 of the projectile 100C is spin stabilized in flight. In this aspect, the rotational velocity of the body 1020 about the geometric axis of rotation 400 in combination with the degraded adhesive 1010 effects unbinding of the portion 1050 of the powdered metal 1001 from the body 1020.

The projectile 100C may also include, in one or more aspects, the one or more weights 112. Here, the one or more weights 112 may be positioned relative to one another in any suitable manner (such as in a mold) and a mixture comprising the powdered metal 1001 and adhesive 1010 is poured or otherwise packed around the one or more weights 112 (or the one or more weights 112 are inserted into the mixture of the powdered metal 1001 and adhesive 1010) so as to encase the one or more weights 112 within the solidified powdered metal 1001 and adhesive 1010 mixture. As the portion 1050 of the powdered metal 1001 is unbound or ejected from the body 1020 during flight of the projectile 100C, the one or more weights 112 are released from the body 1020 in the manner described above. In a manner similar to that described above, each of the one or more weights 112 is less than about 10% to about 15% of the total pre-flight mass of the projectile 100D.

The projectile 100C is formed by providing a mold having a cavity, where the cavity has a shape corresponding to the predetermined shape of the projectile 100C. A mixture of powdered metal 1001 and adhesive 1010 is poured or otherwise inserted into the cavity of the mold so that the mixture of powdered metal 1001 and adhesive 1010 solidifies. The one or more weights 112 may be inserted into the mold prior to or after insertion of the mixture of powdered metal 1001 and adhesive 1010 into the mold but before solidification of the mixture of powdered metal 1001 and adhesive 1010.

Referring to FIGS. 11A, 11B, and 11C, another aspect of the projectile 100D is illustrated. In this aspect, the projectile includes a body 1120 formed from the low melt fusible alloy 111. Here the low melt fusible alloy 111 is molded so as to form a predetermined shape of the projectile 100D, such as an aerodynamic shape similar to any conventional projectile. The low melt fusible alloy 111 is configured, in a manner similar to that describe above, to melt during flight of the projectile 100D so as to eject melted alloy 1150 from the body 1120 so as to reduce the projectile 100D to a reduced mass that is less than a total pre-flight mass of the projectile 100D. The ejection of the melted alloy 1150 from the body 1120 is effected by a rotational velocity of the body 1120 during flight.

In a manner similar to that described above, the body 1120 has an outer surface 1170 with an absorptivity of 0.1 or greater. In one or more aspects, the outer surface 1170 comprises the absorptivity coating 270C that effects the absorptivity of 0.1 or greater. In flight of the projectile 100D, the exposure of the body 1120 to one or more of solar radiation and friction heat effects melting of the low melt fusible alloy 111 so that the melted alloy 1150 is ejected from the body 1120. Each portion of the melted alloy 1150 ejected from the body 1120 is less than about 10% to about 15% of the total pre-flight mass of the mass reducing projectile.

The projectile 100D, in one or more aspects, also includes a reinforcing matrix core 1130. For example, as can be seen in FIG. 11B (which illustrates a cross-sectional view of the projectile 100D), the reinforcing matrix core 1130 is encased in the low melt fusible alloy 111. The reinforcing matrix core 1130 is any suitable fibrous matrix (e.g., such as, but not limited to, metallic wools and metallic gauzes) into and through which the low melt fusible alloy 111 is dispersed to that the fibrous matrix reinforces the low melt fusible alloy 111. Examples of a suitable reinforcing matrix core 1130 include, but are not limited to, steel wools, brass wools, bronze, and copper wools. The reinforcing matrix core 1130 is less than about 10% to about 15% of the total pre-flight mass of the projectile 100D. Here, the reinforcing matrix core 1130 may be positioned within a mold and the low melt fusible alloy 111 is poured through and around the reinforcing matrix core 1130 so as to encase the reinforcing matrix core within the solidified low melt fusible alloy 111 (e.g., forming the body 1120).

The projectile 100D may also include, in one or more aspects, the one or more weights 112. Here, the one or more weights 112 may be positioned relative to one another (and in some aspects the reinforcing matrix core 1130) in any suitable manner (such as in a mold) and the low melt fusible alloy 111 is poured around the one or more weights 112 so as to encase the one or more weights 112 within the solidified low melt fusible alloy. As the low melt fusible alloy 111 melts during flight of the projectile 100D, the one or more weights 112 (and in some aspects the reinforcing matrix core 1130) are released from the body 1120. In a manner similar to that described above, each of the one or more weights 112 is less than about 10% to about 15% of the total pre-flight mass of the projectile 100D.

Referring to FIGS. 12A, 12B, 12C, 12D, 12E, and 12F a projectile 100E is illustrated in accordance with another aspect of the present disclosure. In this aspect, the reduction in mass of the projectile 100E is effected mechanically through the rotational velocity of the spin stabilized projectile 100E. In this aspect, the projectile 100E includes a shell 1212 that forms an internal cavity 1221. The shell 1212 is segmented and includes at least a rear segment 1230 and a front segment 1231 that are coupled to each other in a manner similar to that described above with respect to FIG. 7. At least the rear segment 1230 includes at least one ejection aperture 1270 that extends through a side wall 1213 of the shell 1212, where the ejection aperture 1270 opens up to both the internal cavity 1221 and an external environment 1215 (e.g., ambient atmosphere) that surrounds the projectile 100E.

In one or more aspects, the at least one ejection aperture 1270 comprises a plurality of ejection apertures arranged in at least one column 1266 that extends in direction along the geometric axis of rotation 400 of the projectile 100E. In one or more aspects the at least one column 1266 comprises a plurality of columns 1266 that are angularly equally spaced about the geometric axis of rotation 400. In the aspect illustrated in FIGS. 12A-12F there are a plurality of ejection apertures arranged in columns 1266. In the example illustrated in FIGS. 12A-12F, there are four columns 1266 arranged about 90° apart (relative to the geometric axis of rotation 400); however, in other aspects there may be any suitable number of columns 1266 arranged any suitable angular distance apart from each other with each column 1266 including any suitable number of ejection apertures 1270 (noting that the number of ejection apertures in each column do not have to be the same—see FIGS. 14A and 14B where two of the four columns 1266 each have three ejection apertures 1270 and two of the four columns 1266 each have two ejection apertures 1270).

The projectile 100E includes ballast 1264 disposed within the internal cavity 1221. The at least one ejection aperture 1270 is shaped and sized so that the ballast 1264 passes from the internal cavity 1221 through the at least one ejection aperture 1270 to the external environment 1215 that is external to the shell 1212. The ballast 1264 is any suitable ballast configured to pass through the at least one ejection aperture 1270. For example, the ballast 1264 is one or more of, but not limited to, powdered metal, granular material, and a plurality of spheres.

As with the other embodiments described herein, the projectile 100E is a spin stabilized projectile. The internal cavity 1221 is configured (e.g., shaped) to funnel the ballast 1264 to each of the at least one ejection aperture 1270, wherein the ballast 1264 is ejected from the at least one ejection aperture 1270 by centrifugal force.

Referring to FIGS. 12C, 12D, 12E, and 12F, the internal cavity 1221 is comprised of a plurality of opposing modified frustoconical cavity segments 1280 so that each opposing modified frustoconical cavity segment 1280 is in open communication with an adjacent opposing modified frustoconical cavity segment 1280. Each opposing modified frustoconical cavity segment includes a first modified frustoconical cavity portion 1281 and a second modified frustoconical cavity portion 1282 that are arranged relative to each other in an opposition relationship so that what would be the larger diameter ends of the frustum are arranged end to end and define a polygonal interface 1284.

An ejection aperture 1270 is disposed at each vertex 1285 of this polygonal interface 1284 so that the opposing modified frustoconical cavity segment funnels the ballast to and along the polygonal interface 1284 for passage of the ballast 1264 through the ejection aperture 1270 at the vertex 1285. The smaller diameter of the frustum of each of the first modified frustoconical cavity portion 1281 and a second modified frustoconical cavity portion 1282 defines a circular interface 1283 with an adjacent opposing modified frustoconical cavity segment 1280 or terminates at a longitudinal end of the internal cavity 1221 as illustrated in FIGS. 12C, 12D, 12E, and 12F.

FIGS. 14A and 14B illustrate the projectile 100E with an internal cavity 1221 similar to that described above with respect to FIGS. 12C, 12D, 12E, and 12F; however, in this aspect the internal cavity has a plurality of opposing (unmodified) frustoconical cavity segments 1280U. Each opposing frustoconical cavity segment 1280U includes a first frustoconical cavity portion 1281U and a second frustoconical cavity portion 1282U arranged relative to each other in an opposition relationship so that the larger diameter ends of the frustum are arranged end to end and define a circular interface 1284U and the smaller diameter ends of the frustum defines another circular interface 1283 with an adjacent opposing frustoconical cavity segment 1280U or terminates at a longitudinal end of the internal cavity 1221 as illustrated in FIGS. 14A and 14B.

Referring to FIGS. 13A and 13B, the projectile 100E is illustrated with an internal cavity 1221 that has a stacked frustum configuration. Here, the internal cavity 1221 has a plurality of frustum shaped cavities 1310 arranged end to end so that each frustum shaped cavity 1310 is in open communication with an adjacent frustum shaped cavity 1310. In this aspect, the large diameter end of one frustum shaped cavity 1310 interfaces with the small diameter end of an adjacent frustum shaped cavity 1310 at a circular interface 1381 so that one or more of the small diameter end and the large diameter end of each frustum shaped cavity 1310 funnels the ballast 1264 to at least one ejection aperture 1270 disposed at a respective one of the one or more of the small diameter end and the large diameter end of each frustum shaped cavity 1310. In this aspect there are eight columns 1266 of ejection apertures (noting that only five columns are illustrated in FIG. 13B); however, in other aspects the projectile 100E includes any suitable number of columns each having any suitable number of ejection apertures.

Referring again to FIG. 12A, the projectile 100E includes, in one or more aspects, a low melt fusible alloy coating 1299 on an outer surface 270 of the shell 1212. The low melt fusible alloy coating 1299 is any suitable low melt fusible alloy, such as those described herein. The low melt fusible alloy 1299 prevents egress of the ballast 1264 from the at least one ejection aperture 1270 with the low melt fusible alloy coating 1299 below a melting temperature of the low melt fusible alloy coating 1299. With the low melt fusible alloy coating 1299 above the melting temperature of the low melt fusible alloy coating 1299, the low melt fusible alloy coating 1299 is ejected from the shell 1212 so that the ballast 1264 is ejected from the at least one ejection aperture 1270. The low melt fusible alloy coating 1299 comprises any suitable low melt fusible alloy such as those described herein. In other aspects, the ejection apertures 1270 are plugged with a low melt fusible alloy while the outer surface 270 remains uncoated.

While different aspects of the present disclosure have been described above, it should be understood that features of one aspect can be combined with (e.g., incorporated into) other aspects without departing from the scope of the present disclosure.

The following clauses are provided in accordance with the aspects of the present disclosure:

A1. A mass reducing projectile is provided and includes:

a shell;

one or more weights disposed within the shell; and a low melt fusible alloy disposed within the shell so as to encase the one or more weights within the shell.

A2. The mass reducing projectile of clause A1, wherein the one or more weights comprise one or more of rods and spheres.

A3. The mass reducing projectile of clause A1, wherein the shell comprises an outer surface with an absorptivity of 0.1 or greater.

A4. The mass reducing projectile of clause A3, wherein the outer surface comprises an absorptivity coating that effects the absorptivity.

A5. The mass reducing projectile of clause A1, wherein the shell is configured to increase in temperature during flight to a temperature above a melting temperature of the low melt fusible alloy.

A6. The mass reducing projectile of clause A1, wherein the shell comprises an internal cavity having a pass-through aperture through which the one or more weights and the low melt fusible alloy are inserted into the internal cavity.

A7. The mass reducing projectile of clause A6, wherein the low melt fusible alloy is configured to melt at a predetermined temperature of the mass reducing projectile so that the one or more weights and the low melt fusible alloy are ejected from the pass-through aperture during flight of the mass reducing projectile.

A8. The mass reducing projectile of clause A7, wherein the shell, each of the one or more weights, and each piece of the ejected low melt fusible alloy is less than about 10% to about 15% of a total pre-flight mass of the mass reducing projectile.

A9. The mass reducing projectile of clause A1, wherein the shell comprises the low melt fusible alloy.

B1. A method is provided forming a mass reducing projectile that comprises a shell, one or more weights, and a low melt fusible alloy, the method includes:

stably holding the shell;

inserting the one or more weights into an internal cavity of the shell; and inserting the low melt fusible alloy into the internal cavity so as to fill the internal cavity and encase the one or more weights within the internal cavity.

B2. The method of clause B1, further comprising spinning the shell and the one or more weights around a geometric axis of rotation of the shell so as to spin balance the mass reducing projectile about the geometric axis of rotation.

B3. The method of clause B1, further comprising coating an outer surface of the shell with an absorptivity coating so as to increase an absorptivity of the projectile.

B4. The method of clause B1, further comprising coating an internal cavity of the shell with a non-reactive coating so as to prevent chemical interaction between a material of the shell and at least the low melt fusible alloy within the internal cavity.

C1. A munition is provided and includes:

a casing;

an igniter disposed at least partially within the casing;

a propellant disposed within the casing and in communication with the igniter; and a mass reducing projectile disposed at least partially within the casing so as to seal the propellant within the casing, the mass reducing projectile comprising: a shell; one or more weights disposed within the shell; and a low melt fusible alloy disposed within the shell so as to encase the one or more weights within the shell.

C2. The munition of clause C1, wherein the one or more weights comprise one or more of rods and spheres.

C3. The munition of clause C1, wherein the shell comprises an outer surface with an absorptivity of 0.1 or greater.

C4. The munition of clause C3, wherein the outer surface comprises an absorptivity coating that effects the absorptivity.

C5. The munition of clause C1, wherein the shell is configured to increase in temperature during flight to a temperature above a melting temperature of the low melt fusible alloy.

C6. The munition of clause C1, wherein the shell comprises an internal cavity having a pass-through aperture through which the one or more weights and the low melt fusible alloy are inserted into the internal cavity.

C7. The munition of clause C6, wherein the low melt fusible alloy is configured to melt at a predetermined temperature of the mass reducing projectile so that the one or more weights and the low melt fusible alloy are ejected from the pass-through aperture during flight of the mass reducing projectile.

C8. The munition of clause C7, wherein the shell, each of the one or more weights, and each piece of the ejected low melt fusible alloy is less than about 10% to about 15% of a total pre-flight mass of the mass reducing projectile.

C9. The munition of clause C1, wherein the casing is crimped to the mass reducing projectile.

C10. The munition of clause C1, wherein the mass reducing projectile is removable from the casing.

D1. A mass reducing projectile is provided and includes:

a shell comprising: a front segment forming a front internal cavity, and a rear segment forming a rear internal cavity, the rear segment being coupled to the front segment so that the front internal cavity and the rear internal cavity form an internal cavity of the shell; and a phase changing material disposed within the internal cavity;

wherein the shell is configured to increase in temperature to effect a phase change of the phase changing material so that the phase change increase a volume of the phase changing material effecting a separation of at least a portion of one of the front segment and the rear segment from another of the front segment and the rear segment.

D2. The mass reducing projectile of clause D1, wherein the phase changing material is a low melt fusible alloy.

D3. The mass reducing projectile of clause D1, wherein the phase changing material is a fluid and powdered metal mixture.

D4. The mass reducing projectile of clause D3, wherein the fluid is ammonium.

D5. The mass reducing projectile of clause D1, wherein one of the front segment and the rear segment comprises a score line that delineates a separation location of the shell that separates the mass reducing projectile into two or more pieces.

D6. The mass reducing projectile of clause D4, wherein each of the two or more pieces is less than about 10% to about 15% of a total pre-flight mass of the mass reducing projectile.

D7. The mass reducing projectile of clause D1, wherein the front segment and the rear segment are coupled to each by a press fit between the front segment and the rear segment.

D8. The mass reducing projectile of clause D1, wherein the front segment and the rear segment are coupled to each other by a threaded engagement between the front segment and the rear segment.

D9. The mass reducing projectile of clause D1, further comprising one or more weights disposed within the internal cavity.

D10. The mass reducing projectile of clause D9, wherein the one or more weights comprise one or more of rods and spheres.

D11. The mass reducing projectile of clause D1, wherein the shell comprises an outer surface with an absorptivity of 0.1 or greater.

D12. The mass reducing projectile of clause D11, wherein the outer surface comprises an absorptivity coating that effects the absorptivity.

E1. A mass reducing projectile is provided and includes:

a shell comprising:

a frame forming an internal cavity, and a base configured to seal the internal cavity;

an inert vessel having a chemical agent sealed within the inert vessel, the inert vessel being disposed within the internal cavity, where the chemical agent is configured to corrode the shell; and a protrusion extending from the base towards the inert vessel, the protrusion is configured to break the inert vessel so as to release the chemical agent within the internal cavity;

wherein, the chemical agent corrodes the shell so as to separate the shell into two or more pieces.

E2. The mass reducing projectile of clause E1, wherein the inert vessel comprises a glass container.

E3. The mass reducing projectile of clause E1, wherein the protrusion comprises a pin extending through the base, the pin being configured to move relative to the base towards the inert vessel so as to contact and break the inert vessel.

E4. The mass reducing projectile of clause E1, wherein the protrusion is integral with the base and the base is configured to deform so that the protrusion moves towards the inert vessel so as to contact and break the inert vessel.

E5. The mass reducing projectile of clause E1, wherein the chemical agent comprises gallinstan.

E6. The mass reducing projectile of clause E1, wherein the chemical agent comprises an acid.

E7. The mass reducing projectile of clause E1, further comprising one or more weights disposed within the internal cavity, wherein the one or more weights are configured to be ejected from the internal cavity upon separation of the shell into two or more pieces.

E8. The mass reducing projectile of clause E7, wherein each of the two or more pieces and each of the one or more weights is less than about 10% to about 15% of a total pre-flight mass of the mass reducing projectile.

E9. The mass reducing projectile of clause E, wherein each of the two or more pieces is less than about 10% to about 15% of a total pre-flight mass of the mass reducing projectile.

F1. A mass reducing projectile is provided and includes:

a body comprising:

a powdered metal; and an adhesive configured to bind the powdered metal into a predetermined shape;

wherein the adhesive is configured to degrade during flight of the mass reducing projectile so that at least a portion of the powdered metal is unbound from the body and is ejected from the body so as to reduce the mass reducing projectile to a reduced mass that is less than a total pre-flight mass of the mass reducing projectile.

F2. The mass reducing projectile of clause F1, wherein the adhesive is an epoxy.

F3. The mass reducing projectile of clause F1, wherein the powdered metal is tungsten.

F4. The mass reducing projectile of clause F1, wherein each portion of the powdered metal that is unbound from the body is less than about 10% to about 15% of the total pre-flight mass of the mass reducing projectile.

F5. The mass reducing projectile of clause F1, wherein the body is spin stabilized in flight, wherein the rotational velocity of the body at least in part effects unbinding of the portion of the powdered metal from the body.

F6. The mass reducing projectile of clause F1, wherein the adhesive is configured to degrade upon exposure to ultraviolet radiation, wherein degradation of the adhesive at least in part effects unbinding of the portion of the powdered metal from the body.

F7. The mass reducing projectile of clause F1, further comprising one or more weights encased within the body.

F8. The mass reducing projectile of clause F7, wherein each of the one or more weights is less than about 10% to about 15% of the total pre-flight mass of the mass reducing projectile.

G1. A mass reducing projectile is provided and includes:

a body formed from a low melt fusible alloy;

wherein the low melt fusible alloy is configured to melt during flight of the mass reducing projectile so as to eject melted alloy from the body so as to reduce the mass reducing projectile to a reduced mass that is less than a total pre-flight mass of the mass reducing projectile, and where ejection of the melted alloy from the body is effected by a rotational velocity of the body during flight.

G2. The mass reducing projectile of clause G1, wherein the body comprises an outer surface with an absorptivity of 0.1 or greater.

G3. The mass reducing projectile of clause G2, wherein the outer surface comprises an absorptivity coating that effects the absorptivity.

G4. The mass reducing projectile of clause G1, wherein exposure of the body to one or more of solar radiation and friction heat effects melting of the low melt fusible alloy.

G5. The mass reducing projectile of clause G1, wherein each portion of the melted alloy ejected from the body is less than about 10% to about 15% of the total pre-flight mass of the mass reducing projectile.

G6. The mass reducing projectile of clause G1, further comprises a reinforcing matrix core.

G7. The mass reducing projectile of clause G6, wherein the reinforcing matrix core is less than about 10% to about 15% of the total pre-flight mass of the mass reducing projectile.

G8. The mass reducing projectile of clause G1, further comprising one or more weights encased within the body.

G9. The mass reducing projectile of clause G8, wherein each of the one or more weights is less than about 10% to about 15% of the total pre-flight mass of the mass reducing projectile.

H1. A mass reducing projectile is provided and includes:

a shell forming an internal cavity;

ballast disposed within the internal cavity; and at least one ejection aperture extending through a side wall of the shell, each of the at least one ejection aperture being shaped and sized so that the ballast passes from the internal cavity through the at least one ejection aperture to an external environment that is external to the shell.

H2. The mass reducing projectile of clause H1, wherein the mass reducing projectile is a spin stabilized projectile and the internal cavity is configured to funnel the ballast to each of the at least one ejection aperture, wherein the ballast is ejected from the at least one ejection aperture by centrifugal force.

H3. The mass reducing projectile of clause H1, wherein the ballast comprises a powdered metal.

H4. The mass reducing projectile of clause H1, wherein the ballast comprises a granular material.

H5. The mass reducing projectile of clause H1, wherein the ballast comprises a plurality of spheres.

H6. The mass reducing projectile of clause H1, further comprising a low melt fusible alloy coating on an outer surface of the shell, wherein the low melt fusible alloy coating prevents egress of the ballast from the at least one ejection aperture with the low melt fusible alloy coating below a melting temperature of the low melt fusible alloy coating, and with the low melt fusible alloy coating above the melting temperature of the low melt fusible alloy coating, the low melt fusible alloy coating is ejected from the shell so that the ballast is ejected from the at least one ejection aperture.

H7. The mass reducing projectile of clause H1, wherein the at least one ejection aperture comprises a plurality of ejection apertures arranged in at least one column that extends in direction along a geometric axis of rotation of the mass reducing projectile.

H8. The mass reducing projectile of clause H7, wherein the at least one column comprises a plurality of columns that are angularly equally spaced about the geometric axis of rotation.

H9. The mass reducing projectile of clause H1, wherein the shell is segmented.

In the figures, referred to above, solid lines, if any, connecting various elements and/or components may represent mechanical, electrical, fluid, optical, electromagnetic, wireless and other couplings and/or combinations thereof. As used herein, "coupled" means associated directly as well as indirectly. For example, a member A may be directly associated with a member B, or may be indirectly associated therewith, e.g., via another member C. It will be understood that not all relationships among the various disclosed elements are necessarily represented. Accordingly, couplings other than those depicted in the drawings may also exist. Dashed lines, if any, connecting blocks designating the various elements and/or components represent couplings similar in function and purpose to those represented by solid lines; however, couplings represented by the dashed lines may either be selectively provided or may relate to alternative examples of the present disclosure. Likewise, elements and/or components, if any, represented with dashed lines, indicate alternative examples of the present disclosure. One or more elements shown in solid and/or dashed lines may be omitted from a particular example without departing from the scope of the present disclosure. Environmental elements, if any, are represented with dotted lines. Virtual (imaginary) elements may also be shown for clarity. Those skilled in the art will appreciate that some of the features illustrated in the figures, may be combined in various ways without the need to include other features described in the figures, other drawing figures, and/or the accompanying disclosure, even though such combination or combinations are not explicitly illustrated herein. Similarly, additional features not limited to the examples presented, may be combined with some or all of the features shown and described herein.

In FIG. 5, referred to above, the blocks may represent operations and/or portions thereof and lines connecting the various blocks do not imply any particular order or dependency of the operations or portions thereof. Blocks represented by dashed lines indicate alternative operations and/or portions thereof. Dashed lines, if any, connecting the various blocks represent alternative dependencies of the operations or portions thereof. It will be understood that not all dependencies among the various disclosed operations are necessarily represented. FIG. 13 and the accompanying disclosure describing the operations of the method(s) set forth herein should not be interpreted as necessarily determining a sequence in which the operations are to be performed. Rather, although one illustrative order is indicated, it is to be understood that the sequence of the operations may be modified when appropriate. Accordingly, certain operations may be performed in a different order or substantially simultaneously. Additionally, those skilled in the art will appreciate that not all operations described need be performed.

In the foregoing description, numerous specific details are set forth to provide a thorough understanding of the disclosed concepts, which may be practiced without some or all of these particulars. In other instances, details of known devices and/or processes have been omitted to avoid unnecessarily obscuring the disclosure. While some concepts will be described in conjunction with specific examples, it will be understood that these examples are not intended to be limiting.

Unless otherwise indicated, the terms "first", "second", etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Reference herein to "one example" means that one or more feature, structure, or characteristic described in connection with the example is included in at least one implementation. The phrase "one example" in various places in the specification may or may not be referring to the same example.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

Different examples of the apparatus(es) and method(s) disclosed herein include a variety of components, features, and functionalities. It should be understood that the various examples of the apparatus(es) and method(s) disclosed herein may include any of the components, features, and functionalities of any of the other examples of the apparatus (es) and method(s) disclosed herein in any combination, and all of such possibilities are intended to be within the scope of the present disclosure.

Many modifications of examples set forth herein will come to mind to one skilled in the art to which the present disclosure pertains having the benefit of the teachings presented in the foregoing descriptions and the associated drawings.

Therefore, it is to be understood that the present disclosure is not to be limited to the specific examples illustrated and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims. Accordingly, parenthetical reference numerals in the appended claims are presented for illustrative purposes only and are not intended to limit the scope of the claimed subject matter to the specific examples provided in the present disclosure.

What is claimed is:

1. A mass reducing projectile comprising:
a shell;
one or more weights disposed within the shell; and
a low melt fusible alloy disposed within the shell so as to encase the one or more weights within the shell;
wherein the shell is configured to increase in temperature during flight to a temperature above a melting temperature of the low melt fusible alloy and the low melt fusible alloy is configured to melt at a predetermined temperature of the mass reducing projectile so that the one or more weights and the low melt fusible alloy are ejected from a pass-through aperture of the shell during flight of the mass reducing projectile.

2. The mass reducing projectile of claim 1, wherein the one or more weights comprise one or more of rods and spheres.

3. The mass reducing projectile of claim 1, wherein the shell comprises an outer surface with an absorptivity of 0.1 or greater.

4. The mass reducing projectile of claim 3, wherein the outer surface comprises an absorptivity coating that effects the absorptivity.

5. The mass reducing projectile of claim 1, wherein the shell comprises an internal cavity having the pass-through aperture through which the one or more weights and the low melt fusible alloy are inserted into the internal cavity.

6. The mass reducing projectile of claim 5, wherein the shell, each of the one or more weights, and each piece of the ejected low melt fusible alloy is less than about 10% to about 15% of a total pre-flight mass of the mass reducing projectile.

7. A method forming a mass reducing projectile that comprises a shell, one or more weights, and a low melt fusible alloy, the method comprising:
stably holding the shell;
inserting the one or more weights into an internal cavity of the shell; and
inserting the low melt fusible alloy into the internal cavity so as to fill the internal cavity and encase the one or more weights within the internal cavity;
wherein the shell is configured to increase in temperature during flight to a temperature above a melting temperature of the low melt fusible alloy and the low melt fusible alloy is configured to melt at a predetermined temperature of the mass reducing projectile so that the one or more weights and the low melt fusible alloy are ejected from a pass-through aperture of the shell during flight of the mass reducing projectile.

8. The method of claim 7, further comprising spinning the shell and the one or more weights around a geometric axis of rotation of the shell so as to spin balance the mass reducing projectile about the geometric axis of rotation.

9. The method of claim 7, further comprising coating an outer surface of the shell with an absorptivity coating so as to increase an absorptivity of the mass reducing projectile.

10. The method of claim 7, further comprising coating an internal cavity of the shell with a non-reactive coating so as to prevent chemical interaction between a material of the shell and at least the low melt fusible alloy within the internal cavity.

11. A munition comprising:

a casing;

an igniter disposed at least partially within the casing;

a propellant disposed within the casing and in communication with the igniter; and a mass reducing projectile disposed at least partially within the casing so as to seal the propellant within the casing, the mass reducing projectile comprising:

a shell;

one or more weights disposed within the shell; and a low melt fusible alloy disposed within the shell so as to encase the one or more weights within the shell;

wherein the shell is configured to increase in temperature during flight to a temperature above a melting temperature of the low melt fusible alloy and the low melt fusible alloy is configured to melt at a predetermined temperature of the mass reducing projectile so that the one or more weights and the low melt fusible alloy are ejected from a pass-through aperture of the shell during flight of the mass reducing projectile.

12. The munition of claim 11, wherein the one or more weights comprise one or more of rods and spheres.

13. The munition of claim 11, wherein the shell comprises an outer surface with an absorptivity of 0.1 or greater.

14. The munition of claim 13, wherein the outer surface comprises an absorptivity coating that effects the absorptivity.

15. The munition of claim 11, wherein the shell comprises an internal cavity having the pass-through aperture through which the one or more weights and the low melt fusible alloy are inserted into the internal cavity.

16. The munition of claim 15, wherein the shell, each of the one or more weights, and each piece of the ejected low melt fusible alloy is less than about 10% to about 15% of a total pre-flight mass of the mass reducing projectile.

17. The mass reducing projectile of claim 1, wherein the shell comprises the low melt fusible alloy.

18. The method of claim 7, wherein the one or more weights are rods.

19. The method of claim 7, wherein the one or more weights are spheres.

20. The method of claim 7, wherein the one or more weights are rods and spheres.

* * * * *